US007566115B2

(12) United States Patent
Endo et al.

(10) Patent No.: US 7,566,115 B2
(45) Date of Patent: Jul. 28, 2009

(54) LIQUID EJECTING APPARATUS AND PLATEN UNIT

(75) Inventors: Tsunenobu Endo, Nagano-Ken (JP); Sanshiro Takeshita, Nagano-Ken (JP); Hidetoshi Kodama, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 458 days.

(21) Appl. No.: 11/356,617

(22) Filed: Feb. 16, 2006

(65) Prior Publication Data

US 2006/0181576 A1 Aug. 17, 2006

(30) Foreign Application Priority Data

Feb. 16, 2005 (JP) ..... 2005-039298
Feb. 16, 2005 (JP) ..... 2005-039299
Feb. 16, 2005 (JP) ..... 2005-039300

(51) Int. Cl.
*B41J 2/06* (2006.01)

(52) U.S. Cl. ..... 347/55; 347/31; 347/36

(58) Field of Classification Search ..... 347/22, 347/28–39, 55, 112
See application file for complete search history.

(56) References Cited

U.S. PATENT DOCUMENTS 6,802,591 B2 * 10/2004 Takahashi ..... 347/36

FOREIGN PATENT DOCUMENTS

| | | |
|---|---|---|
| EP | 0 803 358 A2 | 10/1997 |
| JP | 2003-305840 | 10/2003 |
| JP | 2004-106375 | 4/2004 |
| JP | 2004-202867 | 7/2004 |
| JP | 2004-209980 | 7/2004 |
| JP | 2004-216887 | 8/2004 |

OTHER PUBLICATIONS

European Search Report issued Aug. 10, 2007 in corresponding European Application No. 06003134.1.

* cited by examiner

*Primary Examiner*—Juanita D Stephens
(74) *Attorney, Agent, or Firm*—Edwards Angell Palmer & Dodge LLP; John J. Penny, Jr.

(57) ABSTRACT

There is provided a liquid ejecting apparatus including: a liquid ejecting head that has a conductive nozzle plate and discharges liquid from openings of the nozzle plate to recording material; an absorbing member that is arranged opposite the nozzle plate in a direction in which the liquid is discharged and has electrical conductivity to absorb liquid not attached to the recording material; an electrode member that is adjacent to a rear face of a face facing the nozzle plate in the absorbing member; and a potential difference generating means that generates a potential difference between the nozzle plate and the electrode member to electrically attract the liquid toward the electrode member.

16 Claims, 19 Drawing Sheets

LIQUID EJECTING APPARATUS AND PLATEN UNIT

CROSS REFERENCE TO THE RELATED APPLICATION

The present application claims priority from Japanese Patent Applications Nos. JP 2005-039298, JP 2005-039299, and JP 2005-039300, all filed on Feb. 16, 2005, the contents of which are incorporated herein by reference.

BACKGROUND OF THE INVENTION

1. Field of the Invention

The present invention relates to a liquid ejecting apparatus. More particularly, the present invention relates to a liquid ejecting apparatus that makes liquid discharged from openings of a nozzle plate mounted on a liquid ejecting head adhere to recording material.

2. Description of Related Art

When a liquid ejecting apparatus makes liquid adhere to recording material without leaving blank space on the peripheral border of the recording material, the liquid ejecting apparatus anticipates unavoidable displacement between the recording material and a liquid ejecting head so that the liquid is ejected over a region slightly wider than the dimension of the recording material. For this reason, the liquid is discharged to an area, on which the recording material is not located, in the neighborhood of both side edges and upper and lower ends of the recording material. Thus, in order to prevent surplus liquid from flying in all directions and contaminating the periphery, an absorbing member is arranged at a position facing the liquid ejecting head in the direction in which the liquid is discharged to cause the absorbing member to absorb the surplus liquid not attached to the recording material. At this time, the absorbing member is arranged at a position facing the liquid ejecting head in the direction in which the liquid is discharged and thus the surplus liquid is absorbed into the absorbing member, so that the surplus liquid not attached to the recording material does not fly in all directions.

In addition, recording material may extend and crease when liquid adheres to the material. At this time, when the extended recording material contacts with the absorbing member by bending of the material due to wrinkles, the recording material adheres to the liquid, which has already been absorbed in the absorbing member, to be contaminated. Thus, in anticipation of the extension of the recording material, a gap of about 2 to 4 mm is provided between the recording material and the absorbing member in the liquid ejecting apparatus. Moreover, an interval of about 1 mm is provided between the liquid ejecting head and the recording material.

On the other hand, upon request of resolution improvement of a recording image, a recent liquid ejecting apparatus miniaturizes a droplet discharged from an opening of a nozzle plate to the degree of several pl. Since such a minute droplet has extremely small mass, a droplet, which has once been discharged, rapidly loses kinetic energy due to viscous resistance of an atmosphere. Specifically, the velocity of a droplet less than, e.g., 8 pl reaches generally zero after the droplet flies about 3 mm in the atmosphere. A minute droplet losing kinetic energy takes a balance between falling motion by acceleration of gravity and viscous resistance force of an atmosphere, and thus requires long time up to termination of falling.

In addition, in the case of a distance of 3 to 5 mm obtained by adding the gap between the nozzle plate and the recording material to the interval between the recording material and the absorbing member, the discharge velocity of the liquid ejecting apparatus for a droplet of 3 pl is set highly in order to transfer the droplet from the nozzle plate to a surface of the absorbing member. However, viscous resistance of the atmosphere acting on the droplet further increases so as to reduce travel distance on the contrary. Moreover, when the discharge velocity increases, an extremely minute droplet referred to as satellite ink generated when the droplet leaves the nozzle plate is easy to be generated.

Furthermore, the liquid ejecting apparatus periodically repeats an operation referred to as flushing. The flushing is an operation of sending a driving signal to the liquid ejecting head in a state that the recording material is not in the apparatus, so to speak, to attack liquid. By such an operation, liquid having increased viscosity is removed from a nozzle with a little discharge volume. However, since liquid discharged during this flushing is consumed for only flushing and thus does not contribute to recording to the recording material during a recording operation, a small droplet is discharged to save consumption of liquid. Moreover, since time required for flushing reduces throughput of an original recording operation, liquid is discharged from all nozzles in the shortest time in the flushing. In such a flushing operation, a large quantity of satellite ink is generated.

Most of satellite ink generated as a result of various events as described above becomes aerosol floating in the vicinity of a traveling area of the liquid ejecting head. A part of the aerosol floats to the outside of the liquid ejecting apparatus to adhere to the perimeter of the liquid ejecting apparatus. Moreover, most of aerosol adheres to each portion in the liquid ejecting apparatus before long. Especially, when aerosol adheres on a carrying path of recording material such as a platen, recording material to be next carried is contaminated. Furthermore, when aerosol adheres to an electric circuit, a linear scale, various optical sensors, and so on of the liquid ejecting apparatus, malfunction of the apparatus may be caused. Moreover, when a user touches a part to which aerosol adheres, a hand of the user is also contaminated.

Japanese Patent Application Publication No. 2004-202867 discloses a liquid ejecting apparatus including a function of collecting the aerosol actively.

A liquid ejecting apparatus disclosed in this patent document includes an absorbing member that is arranged at a position facing a nozzle plate in order to absorb surplus liquid that does not adhere to recording material. Moreover, one electrode is a metallic member arranged on a surface of the absorbing member, and the other electrode is a nozzle plate made of metal having openings for discharging liquid. When voltages different from each other are applied to these electrode and nozzle plate, an electric field is formed between both. Moreover, droplets discharged from the nozzle plate in such a liquid ejecting apparatus are charged with electricity to be the same electrode as that of the nozzle plate when being discharged from the nozzle plate. For this reason, since droplets floating as aerosols are charged with electricity, the droplets head for an electrode without being decelerated by coulomb force acting between the droplet and an electric field, and are adsorbed to the electrode having the polarity opposite to that of the droplets. The droplets adsorbed to the electrode are absorbed by a capillary phenomenon, and are finally absorbed in the absorbing member.

In an apparatus as described above, most of the aerosols collected by means of an electric field adhere to the electrode itself. However, as described above, the attached liquid is charged with electricity to be polarity opposite to that of the electrode. On this account, when a large quantity of liquid adheres to the electrode, electric charges in the liquid eliminate the electric field generated by the electrode to weaken an effective electric field. In this way, there has been a problem that a removal effect of aerosols is reduced with the lapse of operating time of the liquid ejecting apparatus.

Moreover, in the liquid ejecting apparatus as described above, liquid having electrical conductivity has the same electric potential as that of the electrode applying a voltage. Therefore, liquid accumulated in a waste liquid absorber also has the same electric potential as that of the electrode. On the other hand, a frame that is structural materials of the liquid ejecting apparatus is formed of a metallic member, and further the metallic member is usually grounded. On this account, when the liquid accumulated in the waste liquid absorber touches the frame, electric currents flow between both. When a short circuit is formed between such a frame and liquid, a voltage applied to the absorbing member descends, and thus a performance of liquid collection by an electric field falls. Moreover, liquid is decomposed by an electric current, and thus inflammable gas and smoke may be generated.

In addition, in case of an absorbing member used in a liquid ejecting apparatus as described above, materials having high absorption speed, in other words, materials having a high percentage of voids are selected, in order to prevent a jump of the reached droplet. However, materials having a high percentage of voids are also materials having small force in view of conservation of liquid. Therefore, when the absorbing member absorbs liquid up to the limit, a liquid level is formed on the surface of absorbing member, and aerosols by a milk crown phenomenon are generated when a droplet collides against the level Thus, there is proposed a method of mounting a waste liquid absorber having a large absorption capacity separately from the absorbing member. That is, since a waste liquid absorber, which is formed of materials having an absorptive capacity larger than that of the absorbing member and having absorptive power by a capillary phenomenon larger than that of the absorbing member, is mounted to be in contact with the absorbing member, it is possible to further guide liquid absorbed by the absorbing member to the waste liquid absorber and thus prevent saturation by the liquid in the absorbing member.

SUMMARY OF THE INVENTION

Therefore, to solve the problem, according to the first aspect of the present invention, there is provided a liquid ejecting apparatus. The liquid ejecting apparatus includes: a liquid ejecting head that has a conductive nozzle plate and discharges liquid from openings of the nozzle plate to recording material; an absorbing member that is arranged opposite the nozzle plate in a direction in which the liquid is discharged and has electrical conductivity to absorb liquid not attached to the recording material; an electrode that is electrically connected to a rear face of a face facing the nozzle plate in said absorbing member; and a potential difference generating means that generates a potential difference between the nozzle plate and said electrode to electrically attract the liquid toward said electrode. In this way, the absorbing member can surely absorb liquid attracted by the potential difference generating means. Moreover, degradation of an electric field by liquid accumulated in the electrode can be prevented.

The liquid ejecting apparatus may further include a platen that is arranged opposite the nozzle plate in a direction in which the liquid is discharged and supports the recording material, and the platen may have a groove in which conductive metal foil acting as the electrode is arranged on a bottom face and accommodate the absorbing member in the groove. In this way, it is possible to reduce the number of components compared with when the electrode is used separately from the platen. Moreover, it is possible to simply conduct operation including the absorbing member in the platen.

In any one of the liquid ejecting apparatuses, the electrode may be continuously formed over the rear face of the absorbing member in the shape of plane. In this way, the electrode can electrically be in contact with the absorbing member on a large area. Moreover, although the absorbing member having a large voiding property is used, it is possible to prevent reduction of a potential difference by disconnection of the inside of the absorbing member.

According to the second aspect of the present invention, there is provided a platen unit. The platen unit includes: a platen that is arranged opposite a nozzle plate in a direction in which liquid is discharged and supports recording material, in a liquid ejecting apparatus; an absorbing member that absorbs liquid and has electrical conductivity; and an electrode that is electrically connected to a rear face in said absorbing member, in which the platen has a groove in which conductive metal foil acting as said electrode is arranged on a bottom face and accommodates the absorbing member in the groove. In this way, the absorbing member can surely absorb liquid attracted by the potential difference generating means. Moreover, it is possible to prevent reduction of a potential difference by liquid accumulated in the periphery of the electrode.

To solve the problem, according to the third aspect of the present invention, there is provided a liquid ejecting apparatus. The liquid ejecting apparatus includes: a liquid ejecting head that has a conductive nozzle plate and discharges liquid from openings of the nozzle plate to recording material; an absorbing member that is arranged opposite the nozzle plate in a direction in which the liquid is discharged and has a voiding property absorbing liquid not attached to the recording material and electrical conductivity; an electrode that is electrically connected to said absorbing member; a potential difference generating means that generates a potential difference between the nozzle plate and said electrode to electrically attract the liquid toward said electrode; a waste liquid absorber that has a voiding property lower than that of said absorbing member and holds the liquid absorbed into said absorbing member by being in contact with at least a part of said absorbing member; and a holding part that electrically insulates said waste liquid absorber from a periphery to hold said absorber. In this way, it is possible to prevent the waste liquid absorber that may electrically be connected to the electrode by liquid from being short-circuited with other members electrically grounded in the liquid ejecting apparatus.

The liquid ejecting apparatus may further include: a cap that covers the nozzle plate of said liquid ejecting head; a tube that carries liquid discharged, into said cap; and a cap side absorber that absorbs the liquid carried by said tube to hold the liquid, and the holding part may electrically insulate the waste liquid absorber from the cap side absorber. In this way, it is possible to prevent a shirt-circuit by liquid in the tube between the nozzle plate and the waste liquid absorber.

The liquid ejecting apparatus may further include: a pump that carries the liquid in said tube; and a pump motor that drives said pump, and the holding part may electrically insulate the waste liquid absorber from the pump motor. In this way, it is possible to prevent short-circuit between the pump motor and the waste liquid absorber.

The liquid ejecting apparatus may further include: a guiding portion that supports said liquid ejecting head; and a conductive frame that supports said guiding portion, and the holding part may electrically insulate the waste liquid absorber from the frame. In this way, it is possible to prevent short-circuit by the frame and the guiding portion between the nozzle plate and the waste liquid absorber.

The liquid ejecting apparatus may further include a head motor that drives said liquid ejecting head along said guiding portion, and the holding part may electrically insulate the waste liquid absorber from the head motor. In this way, it is possible to prevent short-circuit between the head motor and the waste liquid absorber.

The liquid ejecting apparatus may further include: a carrying portion that carries the recording material; and a carrying motor that drives said carrying portion, and the holding part may electrically insulate the waste liquid absorber from the carrying motor. In this way, it is possible to prevent short-circuit between the carrying motor and the waste liquid absorber.

The liquid ejecting apparatus may further include an electric circuit that controls said liquid ejecting head, and the holding part may electrically insulate the waste liquid absorber from the electric circuit. In this way, it is possible to prevent short-circuit between the electric circuit and the waste liquid absorber.

According to the fourth aspect of the present invention, there is provided a platen unit. The platen unit includes: a platen that is arranged opposite a nozzle plate in a direction in which liquid is discharged and supports recording material, in a liquid ejecting apparatus; an absorbing member that has a voiding property absorbing liquid and electrical conductivity; an electrode that is electrically connected to said absorbing member; a waste liquid absorber that has a voiding property lower than that of said absorbing member and holds the liquid absorbed into said absorbing member by being in contact with at least a part of said absorbing member; and a holding part that electrically insulates said waste liquid absorber from a periphery to hold said absorber. In this way, the same effect as that of the first aspect can be obtained.

To solve the problem, according to the fifth aspect of the present invention, there is provided a liquid ejecting apparatus. The liquid ejecting apparatus includes: a liquid ejecting head that has a conductive nozzle plate and discharges liquid droplets from openings of the nozzle plate to recording material; an intermediate electrode that is arranged opposite the nozzle plate in a direction in which the liquid is discharged and has a transit area through which liquid passes; an intermediate potential difference generating means that generates a potential difference between the nozzle plate and said electrode to electrically attract liquid toward said intermediate electrode;, a terminal electrode that is arranged farther away from the nozzle plate than said intermediate electrode in a direction in which liquid is discharged in the liquid ejecting apparatus; a terminal potential difference generating means that generates a potential difference between said intermediate electrode and said terminal electrode in the same direction as that between the nozzle plate and said intermediate electrode, in order to electrically attract the liquid that passes through the transit area of said intermediate electrode to said terminal electrode; and a waste liquid absorber that is arranged next to said terminal electrode and absorbs the liquid attracted to said terminal electrode to hold the liquid. In this way, it is possible to attract liquid to a waste liquid absorbing portion in the vicinity of the terminal electrode arranged farther away than the intermediate electrode without providing the absorbing member in the vicinity of the intermediate electrode.

The liquid ejecting apparatus may further include a short protecting resistor that becomes resistance load when the nozzle plate, the intermediate potential difference generating means, and the terminal potential difference generating means are short-circuited. In this way, it is possible to prevent excess currents from flowing when a short occurs between the nozzle plate and the intermediate electrode or between the nozzle plate and the terminal electrode due to jammed paper.

The liquid ejecting apparatus may further include a platen that supports the recording material and has an electrically insulating property, and the platen may accommodate the intermediate electrode, the terminal electrode, and the waste liquid absorber. In this way, it is possible to prevent short-circuit between the intermediate electrode, the terminal electrode, or the waste liquid absorber and the peripheral members due to contact between them.

In the liquid ejecting apparatus, the potential difference generated by said terminal potential difference generating means between said intermediate electrode and the terminal electrode may be smaller than the potential difference generated by said intermediate potential difference generating means between the nozzle plate and said intermediate electrode. In this way, it is possible to save electric power for driving the terminal potential difference generating means and the intermediate potential difference generating means together.

According to the sixth aspect of the present invention, there is provided a platen unit. The platen unit includes: an intermediate electrode that is arranged opposite a nozzle plate in a direction in which liquid is discharged and has a transit area through which the liquid passes, in a liquid ejecting apparatus; a terminal electrode that is arranged farther away from the nozzle plate than said intermediate electrode in a direction in which liquid is discharged in the liquid ejecting apparatus; a waste liquid absorber that is arranged next to said terminal electrode and absorbs the liquid electrically attracted to said terminal electrode to hold the liquid; and a platen that supports recording material and accommodates said intermediate electrode, said terminal electrode, and said waste liquid absorber. In this way, the same effect as that of the first aspect can be obtained.

The summary of the invention does not necessarily describe all necessary features of the present invention. The present invention may also be a sub-combination of the features described above.

BRIEF DESCRIPTION OF THE DRAWINGS

The above and other objects and features and advantages of the present invention will become more apparent from the following description of the presently preferred exemplary embodiments of the invention taken in conjunction with the accompanying drawings, in which.

DETAILED DESCRIPTION OF THE INVENTION

The invention will now be described based on the preferred embodiments, which do not intend to limit the scope of the present invention, but exemplify the invention. All of the features and the combinations thereof described in the embodiment are not necessarily essential to the invention.

Figure 1:
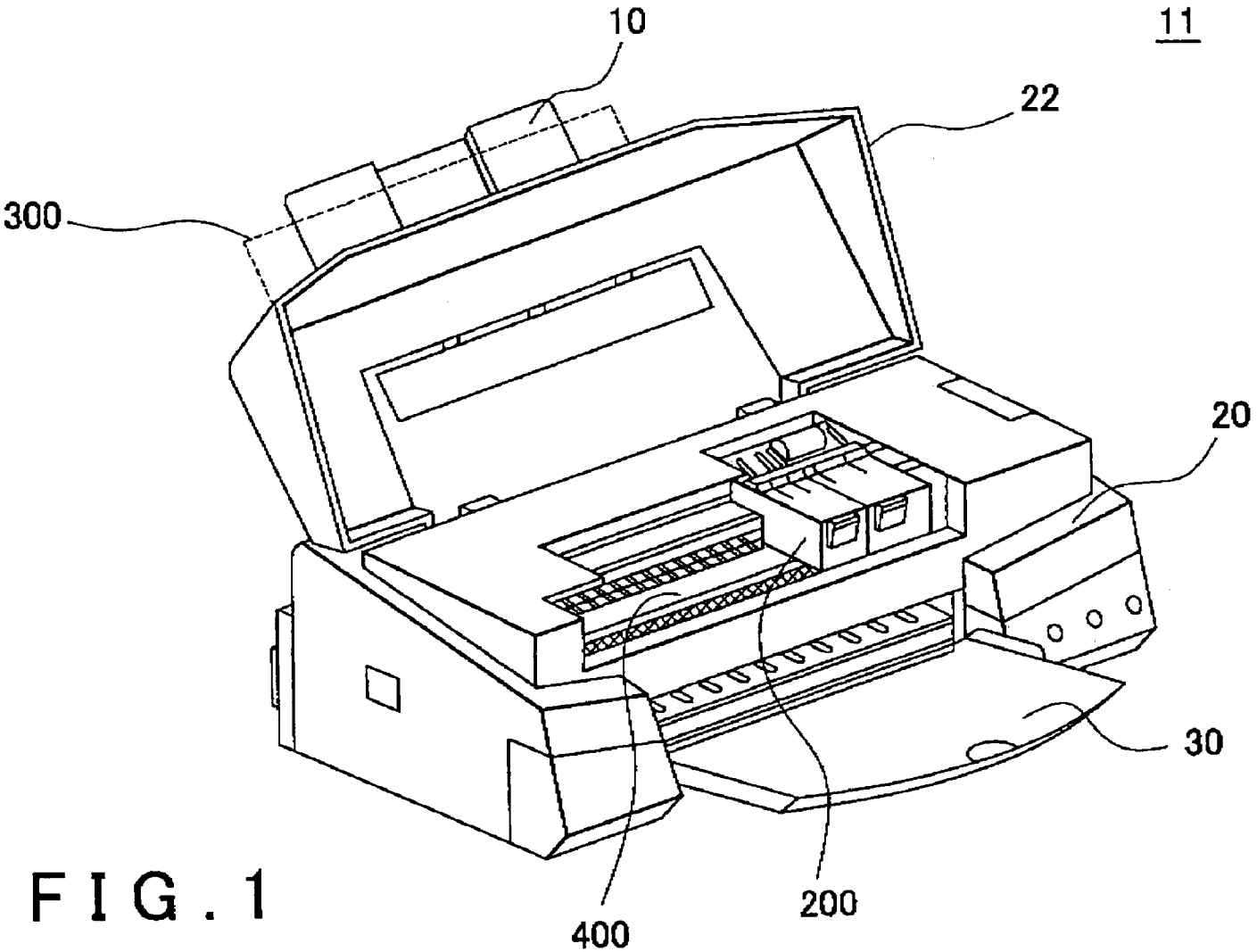
FIG. 1 is a perspective view surveying the whole of an ink-jet type recording apparatus.

FIG. 1 is a perspective view surveying an ink-jet type recording apparatus 11 that is an example of a liquid ejecting apparatus that may be an embodiment of the present invention, and shows a state that a top case 22 as a cover is opened As shown in the present drawing, the ink-jet type recording apparatus 11 includes a bottom case 20 that is a base of the apparatus, a top case 22 that forms a casing with the bottom case 20, a hopper 10 that is mounted to a rear portion of the bottom case 20, and a discharge tray 30 that is formed on a front face of the bottom case 20. Moreover, the ink-jet type recording apparatus 11 includes a platen 400 that is horizontally arranged in the bottom case 20 and a carriage 200 that is arranged on the upper side of the platen 400, on the inner side of the casing.

In the ink-jet type recording apparatus 11 as described above, recording material 300 accommodated on the hopper 10 is sent onto the platen 400 one piece by one piece by means of a carrying in portion not shown, and is further sent to the discharge tray 30 by means of a discharging portion not shown. Moreover, in the ink-jet type recording apparatus 11, the carriage 200 reciprocates in the direction perpendicular to a transportation direction of the recording material 300 on the upper side of the platen 400. Therefore, since the transportation of the recording material 300 and the reciprocation of the carriage 200 are performed alternately, the whole upper face of the recording material 300 can be scanned by the carriage 200 and thus a record operation can be performed.

Figure 2:
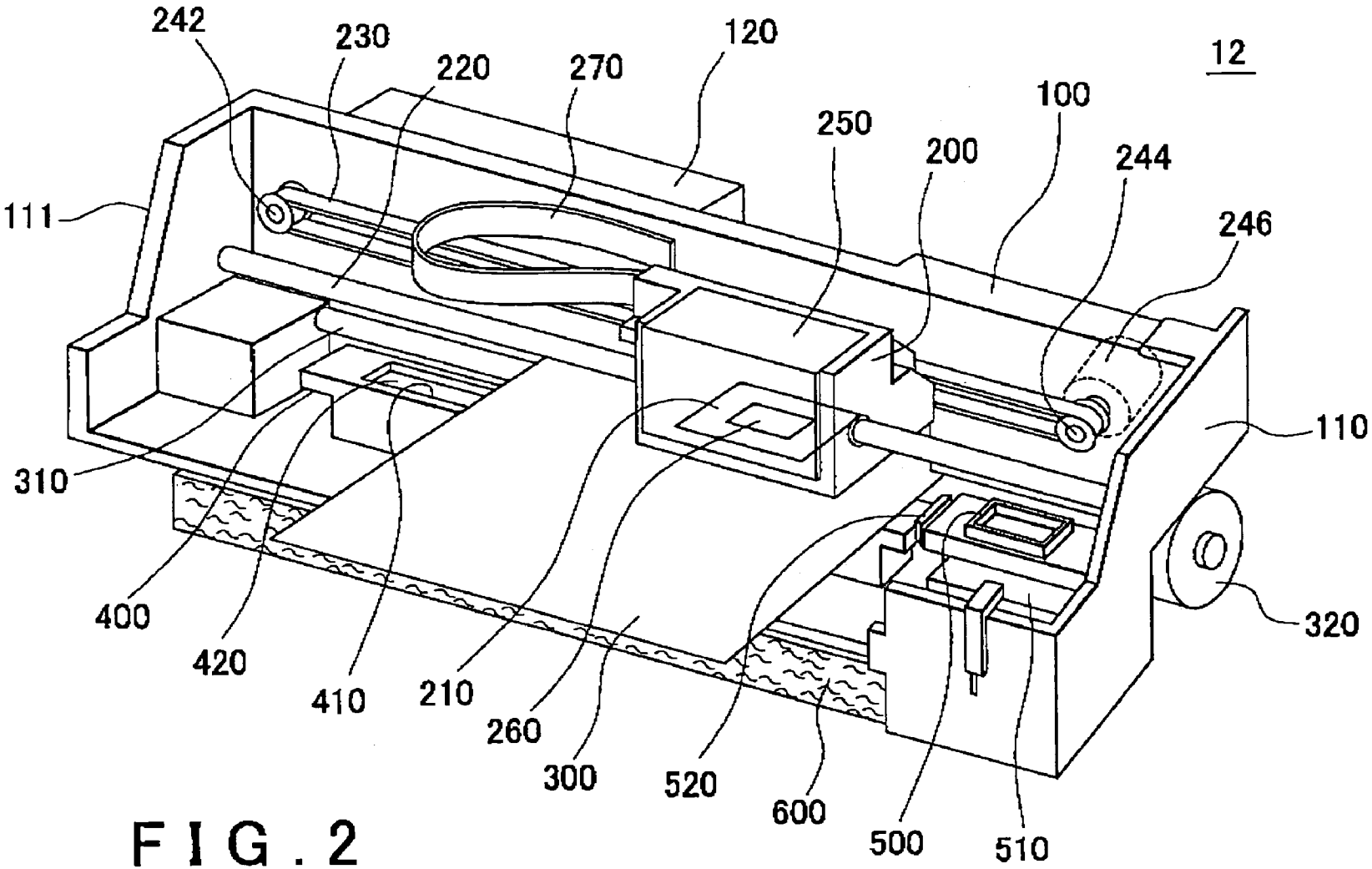
FIG. 2 is a perspective view showing an internal mechanism of an ink-jet type recording apparatus.

FIG. 2 is a perspective view showing an internal mechanism 12 of the ink-jet type recording apparatus 11 shown in FIG. 1 by pulling out a frame 100 and side face portions 110 and 111. As shown in the present drawing, the internal mechanism 12 is formed inside an area bounded by the frame 100 that is arranged backward and generally vertically and a pair of side face portions 110 and 111 that are extended from both ends of the frame 100 to the front parallel to each other.

As shown in FIG. 2, in the internal mechanism 12, the carriage 200 is supported by a guide shaft 220 penetrating through the carriage. Both ends of the guide shaft 220 are supported by the side face portion 110 and the side face portion 111, and the guide shaft 220 is arranged parallel to the frame 100. Therefore, the carriage 200 can horizontally move along the guide shaft 220.

At the back of the carriage 200, a pair of pulleys 242 and 244 and a timing belt 230 that is hung on the pulleys 242 and 244 Ire arranged in the front of the frame 100. One pulley 244 is rotationally driven by a carriage motor 246. Moreover, the timing belt 230 is coupled to a rear portion of the carriage 200. Therefore, the carriage 200 can be reciprocated according to an operation of the carriage motor 246.

Moreover, the carriage 200 loads an ink cartridge 250, and also includes a recording head 210 in the lower face. The recording head 210 includes a nozzle plate 260 made of metal including openings to discharge ink. Therefore, ink is discharged from the carriage 200 toward the lower side.

Furthermore, the carriage 200 is coupled with an electronic circuit 120 in the rear of the frame 100 via a tape-shaped multicore cable 270. Since the multicore cable 270 is flexibly bended according to a movement of the carriage 200, the multicore cable 270 does not disturb a reciprocation of the carriage 200.

The platen 400 is arranged on the lower side of an area along which the carriage 200 passes. The platen 400 supports the recording material 300 passing along a bottom of the carriage 200 from the lower side, in order to hold a distance between the nozzle plate 260 and the recording material 300 constant. Moreover, a concavity 410 is formed on an upper face of the platen 400 and an absorbing member 420 is accommodated in the concavity 410. The absorbing member 420 receives ink discharged from the recording head 210 for an area on which the recording material 300 does not exist. Here, a gap of about 3 to 5 mm is provided between the upper face of the absorbing member 420 and the nozzle plate 260 of the recording head 210.

In addition, as the operating time of the ink-jet type recording apparatus 11 elapses, ink adheres to the absorbing member 420. When the recording material 300 comes in contact with the absorbing member 420 to which ink adheres, the recording material 300 is contaminated with ink. Thus, since a protrusion-shaped portion is formed on an upper face of the platen 400 to support the recording material 300 from the lower side, an interval between both is maintained to prevent them from being in contact with each other.

Moreover, since the absorbing member 420 included within the platen 400 is selected in consideration of absorption speed on the surface, absorption capacity is limited. Thus, a larger waste liquid absorbing member 600 is arranged on the lower side of the platen 400, and the absorbing member 600 comes in contact with the absorbing member 420. In the waste liquid absorbing member 600, the absorption capacity is important, and thus a material having large absorbing power by a capillary phenomenon is selected. Therefore, the waste liquid absorbing member 600 can absorb a large quantity of ink from the absorbing member 420.

A carrying roller 310 is arranged at the back of the platen 400. The carrying roller 310 is driven by a carrying motor 320 arranged in the rear of the frame 100, and sends the recording material 300 onto the platen 400 in cooperation with a driven roller not shown. As described above, the carriage, 200 can reciprocate in the direction perpendicular to a transportation direction of the recording material 300. Therefore, the transportation of the recording material 300 and the reciprocation of the carriage 200 can alternately be performed, whereas the recording head 210 on the undersurface of the carriage 200 can intermittently be operated to discharge and attach ink to an arbitrary area on the recording material 300.

Furthermore, in the internal mechanism 12, a cap member 500 is arranged at a lateral side of the platen 400 near the side face portion 110. The cap member 500 can move up and down, and thus ascends and seals a surface of the nozzle plate 260 when the carriage 200 stops at the home position near the side face portion 110. Moreover, an inside of the cap member 500 is coupled with a pump unit 510. The pump unit 510 can absorb ink attached to the surface of the nozzle plate 260. The ink absorbed by the pump unit 510 is absorbed into the waste liquid absorbing member 600 through a pipe not shown.

Furthermore, a wiping means 520 is arranged between the platen 400 and the cap member 500. The wiping means 520 wipes out the lower face of the nozzle plate 260 to clean it when the carriage 200 released from the cap member 500 passes over the wiping means 520.

Figure 3:
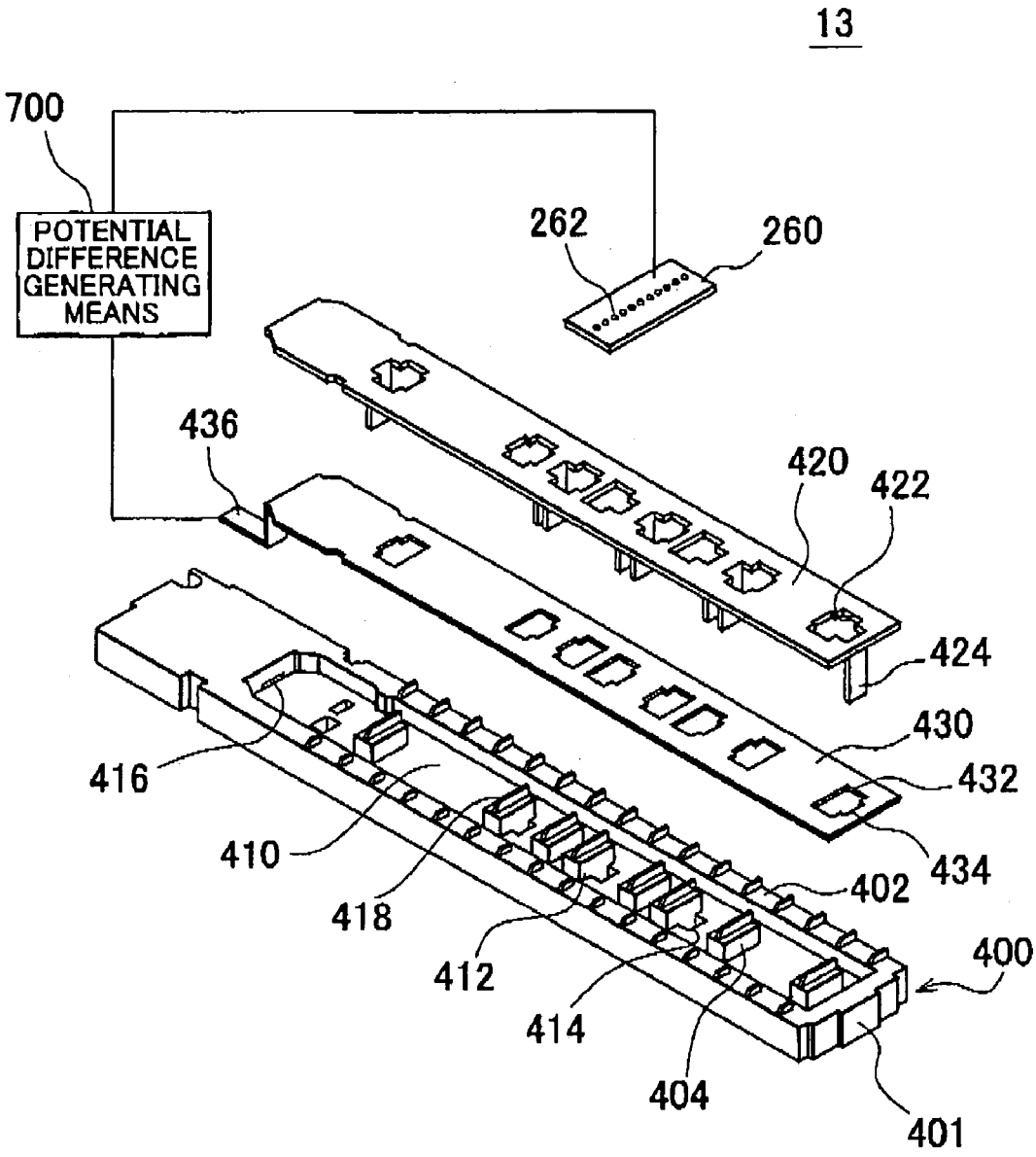
FIG. 3 is a perspective view showing an aerosol collecting mechanism of an ink-jet type recording apparatus.

FIG. 3 is an exploded perspective view showing an aerosol collecting mechanism 13 that may be used in the ink-jet type recording apparatus 11 shown in FIG. 1. Moreover, FIG. 3 also shows the electrical relation between a member of the platen 400 and the nozzle plate 260.

As shown in the present drawing, the platen 400 is formed of a plurality of members including a platen main body 401. The concavity 410 is formed on an upper face of the platen main body 401. Further, some insular portions 412 are formed in the concavity 410. Ribs 418 are respectively formed on edges 402 and 404 extended thinly and longitudinally on the concavity 410 and upper faces on the insular portions 412. The ribs 418 are formed parallel to each other along the transportation direction of the recording material 300 to support the recording material 300 from the lower side at the ends thereof.

Moreover, a terminal inserting hole 416 for inserting a terminal portion 436 of an electrode member 430 as described below is formed at an end of a bottom face of the concavity 410. Similarly, foot inserting holes 414 for inserting foot portions 424 of the absorbing member 420 as described below are formed in the vicinity of the insular portions 412 on the bottom facer of the concavity 410. The platen main body 401 including the insular portions 412, the ribs 418, the terminal inserting hole 416, and the foot inserting holes 414 can be formed of injection molded resin in a unified body.

The electrode member 430 is an electric conductor plate having the substantially same shape as that of the bottom face of the concavity 410 on the platen main body 401, and includes insular portion inserting holes 432 for inserting the insular portions 412 of the platen main body 401 and notches for foot insertion 434 for inserting the foot portions 424 of the absorbing member 420 as described below. Furthermore, a terminal portion 436 for coupling with a potential difference generating means 700 as described below is formed in one end of the electrode member 430. The terminal portion 436 extends from the electrode member 430 to the lower side. Therefore, when the electrode member 430 has been accommodated in the concavity 410, the terminal portion 436 is exposed to the outside of the platen main body 401 through the terminal inserting hole 416.

The electrode member 430 as described above is formed of metal with corrosion resistance against ink of the ink-jet type recording apparatus, for example, wire rod, plate, or foil material of gold, stainless steel, or nickel, or wire rod, plate, or foil material plated with these metals, or a net-like or lattice-like material made by combining these materials. Moreover, as another aspect, the electrode member 430 can be formed of a film layer, a plating layer, a thick film layer, a thin film layer, or the like having electric conductivity, which is directly formed in the concavity 410 of the platen main body 401.

The platen main body 401 accommodates the absorbing member 420 inside the concavity 410 in a method overlapping the absorbing member 420 on the electrode member 430. The absorbing member 420 has the substantially same surface configuration as the concavity 410. Moreover, the absorbing member 420 has insular portion inserting holes 422 for inserting the insular portions 412 of the platen main body 401 at the positions corresponding to the arrangement of insular portions 412.

Furthermore, the absorbing member 420 includes foot portions 424 respectively extending on the lower side from the edges of the insular portion inserting holes 422. Each foot portion 424 utilizes a part of a portion that becomes unnecessary to form the insular portion inserting hole 422, in order to be formed by downward bending the unnecessary portion after shaping the absorbing member 420. The foot portions 424 are inserted into the notches for foot insertion 434 of the electrode member 430 and the foot inserting holes 414 of the platen main body 401 to be extended on the lower side of the platen main body 401, and lower ends of the foot portions contacts with the waste liquid absorbing member 600 shown in FIG. 2.

In addition, the absorbing member 420 directly receives a droplet of ink not attached to the recording material 300 after being discharged from the nozzle plate 260. At this time, when absorption speed of the absorbing member 420 is slow, so-called a milk crown phenomenon occurs due to an impact by which ink collides with the surface of the absorbing member 420. A minute droplet occurs on the periphery of a milk crown, and the droplet causes the generation of an aerosol. Thus, a foaming material having high percentage of voids is selected as a material of the absorbing member 420 in serious consideration of the height of absorption speed.

Moreover, the absorbing member 420 can be formed of a conductive material having a resistance value of surface resistance less than or equal to $10^8\Omega$. Specifically, a material made by mixing and foaming a conductive material such as metal and carbon with resin such as polyethylene and polyurethane, a material made by attaching a conductive material such as metal and carbon to a resin foaming material such as polyethylene and polyurethane, or a material made by plating resin can be used as the absorbing member. Moreover, a material made by impregnating a resin foaming material such as polyethylene and polyurethane with an electrolytic solution can be used as the absorbing member 420.

In a series of members shown in FIG. 3, the electrode member 430 is coupled with the nozzle plate 260 through the potential difference generating means 700 as typically shown in the present drawing. Therefore, an electric field, e.g., not less than 25 kV/m is formed between the nozzle plate 260 and the electrode member 430.

Moreover, since the absorbing member 420 is coupled with the waste liquid absorbing member 600 through a lot of foot portions 424, ink absorbed into the absorbing member 420 is immediately led to the waste liquid absorbing member 600 via each foot portion 424. Therefore, a little ink adheres to the electrode member 430 arranged on a lower layer of the absorbing member 420, and thus an electric field of the electrode member 430 side by the adhesion of ink is not almost degraded.

Furthermore, the electrode member 430 covers the substantially whole bottom face of the concavity 410 of the platen main body 401, and the absorbing member 420 having the generally same shape as the electrode member is superimposed and accommodated thereupon. In this manner, since the whole lower face of the absorbing member 420 touches the electrode member 430, the absorbing member 420 and the electrode member 430 are electrically connected to each other. Thus, the whole absorbing member 420 has uniform electric potential generally equal to the electrode member 430 even if electrically discontinuous portions are in the internal structure of the absorbing member 420.

Figure 4:
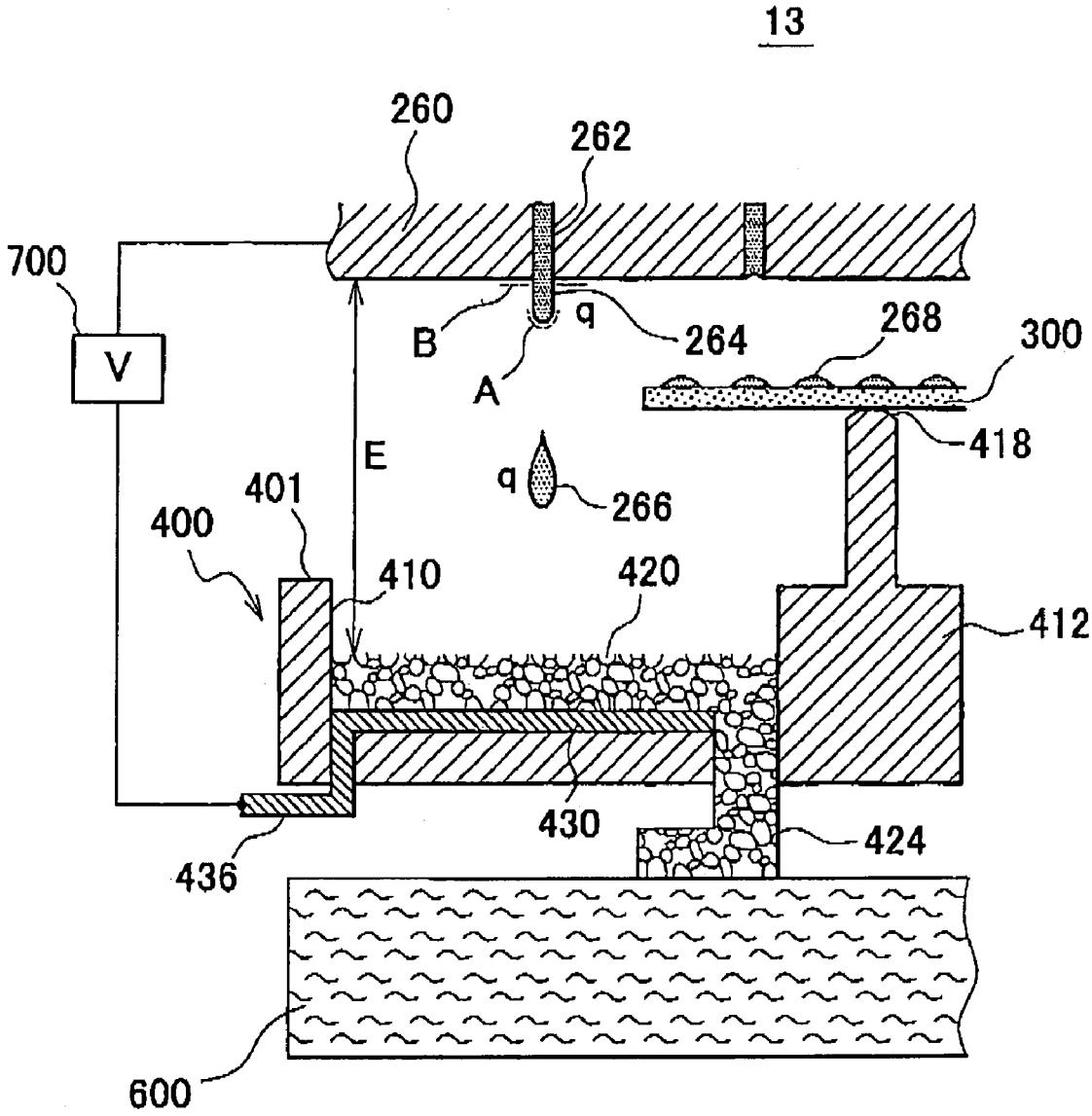
FIG. 4, is a side view enlarging and showing a part of an aerosol collecting mechanism shown in FIG. 3.

FIG. 4 is a conceptual diagram enlarging and showing the periphery of the nozzle plate 260 during an operation in the ink-jet type recording apparatus 11 shown in FIGS. 1 to 3. In FIG. 4, since the same components as those of FIGS. 1 to 3 have the same reference numerals, their descriptions will be omitted.

As shown in the present drawing, the plurality of openings 262 for discharging ink is formed in the nozzle plate 260. In general, the recording material 300 supported by the rib 418 of the platen body 401 from the lower side exists right under the nozzle plate 260. Therefore, the droplet 268 discharged from the nozzle plate 260 adheres to the recording material 300.

However, when attaching ink to edges of the recording material 300 without white space, in side edges and front and rear ends of the recording material 300, the recording material 300 does not exist right under a part of the openings 262. In this case, a kinetic energy given to the droplet 266 by the discharge from the opening 262 is rapidly lost by viscous resistance of an atmosphere, and a part of the droplet is, completely lost a long time before arriving at the absorbing member 420. Moreover, since mass of the droplet 266 is small extremely, a falling motion by acceleration of gravity and the viscous resistance force balance each other, and fall velocity of the droplet 266 becomes extremely late In this way, there is generated an aerosol floating on the lower side of the nozzle plate 260.

However, in the ink-jet type recording apparatus 11 shown in FIG. 4, an electric field E is formed between the nozzle plate 260 and the absorbing member 420. That is, as already described with reference to FIG. 3, one end of the potential difference generating means 700 is connected to the nozzle plate 260, and the other end of the potential difference generating means 700 is connected to the electrode member 430 through the terminal portion 436. Moreover, the whole upper face of the electrode member 430 is in contact with the whole lower face of the absorbing member 420. Further, the absorbing member 420 has electrical conductivity. Therefore, the upper face of the absorbing member 420 has the generally same potential as that of the electrode member 430, and further the potential is uniform overall.

The ink pushed out from the opening 262 in the ink-jet type recording apparatus 11 becomes an ink pillar 264 drooping from the nozzle plate 260 at the moment just before the ink becomes the droplet 266. At this time, there is generated so-called lightning conductor effect between a leading end A of the ink pillar 264 and the lower face of the nozzle plate 260 on an area B in the vicinity of the ink pillar 264. That is, the above lightning conductor effect means that the area B on the surface of the nozzle plate 260 surrounded with a conical shape including a range of a vertex angle from 50° to 60° with the leading end A (a lower end in the present drawing) of the ink pillar 264 at the top contributes to the charge of the droplet 266. By this, lightning conductor effect, the droplet 266 has an electric charge larger than an electric charge corresponding to a horizontal cross section of the ink pillar 264.

The ink pillar 264 becomes the droplet 266 apart from the nozzle plate 260 before long However, this droplet 266 is charged with an electric charge q accumulated by the lightning conductor effect as described above. Therefore, the droplet 266 having the charge q obtains a kinetic energy by a coulomb, force Fe (qE) from an electric field E, and thus moves on the lower side without deceleration to finally arrive at the absorbing member 420.

In this case, in the ink-jet type recording apparatus 11 configured as above, the electrode member 430 is arranged at the rear of the absorbing member 420 viewed from the nozzle plate 260 side. Therefore, the charged droplet 266 flying toward the absorbing member 420 does not directly adhere to the electrode member 430.

Further, the foot portion 424 that is a part of the absorbing member 420 is in contact with the waste liquid absorbing member 600 at the lower end. The ink absorbed into the absorbing member 420 is absorbed into the waste liquid absorbing member 600 having high absorbing power through the foot portion 424. Therefore, a large quantity of ink does not stay in the absorbing member 420, and thus the ink included in the absorbing member 420 does not almost adhere to the electrode member 430.

Figure 5:
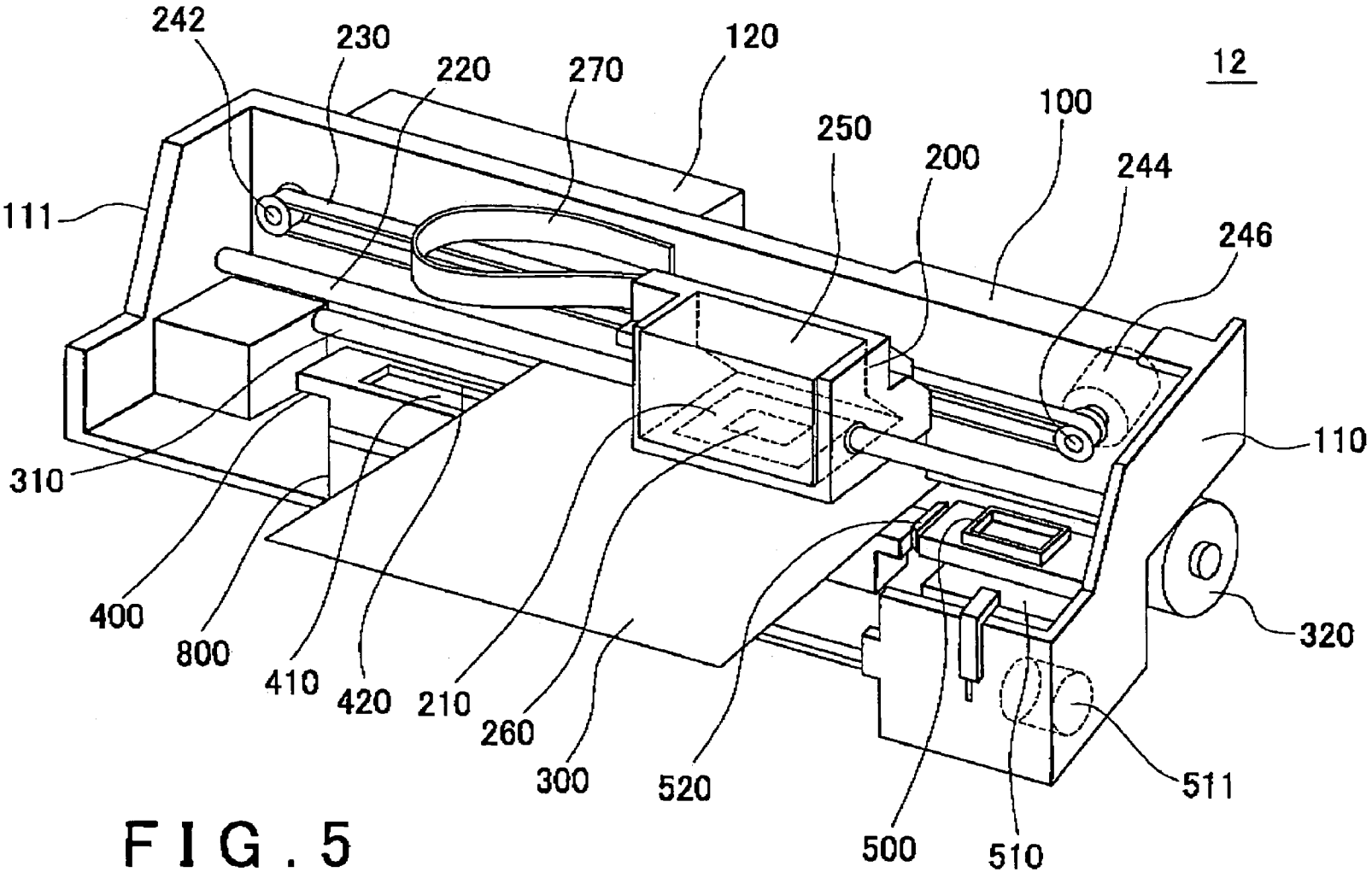
FIG. 5 is a perspective view pulling out and showing the vicinity of an internal mechanism of an ejecting apparatus shown in FIG. 1.

FIG. 5 is a perspective view pulling out and showing the frame 100 and the side face portions 110 and 111 in the internal mechanism 12 of the ink-jet type recording apparatus 11 shown in FIG. 1 according to the second embodiment. In FIG. 5, since the same components as those of an embodiment shown in FIG. 2 have the same reference numerals, their descriptions will be omitted.

In the internal mechanism 12 shown in FIG. 5, a gap of around 2 to 4 mm is provided between the recording material 300 and the absorbing member 420, so that the recording material 300 is not contaminated by contact between the recording material 300 and the absorbing member 420. Moreover, there is an interval of the degree of 1 mm between surfaces of the nozzle plate 260 and the recording material 300.

Moreover, since the absorbing member 420 included within the platen 400 is formed of materials having high percentage of voids in consideration of absorption speed on the surface, absorption capacity is limited. Thus, a holding part 1800 accommodating a larger waste liquid absorber is arranged on the lower side of the platen 400, and the absorber comes in contact with the absorbing member 420. In the waste liquid absorber, the absorption capacity is important, and thus a material having large absorbing power by a capillary phenomenon is selected. Therefore, the waste liquid absorber can absorb a large quantity of ink from the absorbing member 420.

Moreover, the wiping means 520 is arranged between the platen 400 and the cap member 500. The wiping means 520 wipes out the lower face of the nozzle plate 260 to clean it when the carriage 200 released from the cap member 500 passes over the wiping means 520.

Moreover, the inside of the cap member 500 is coupled with the pump unit 510. The pump unit 510 includes a pump motor 511 therein, and can thus absorb ink attached to the surface of the nozzle plate 260 through the cap member 500.

Figure 6:
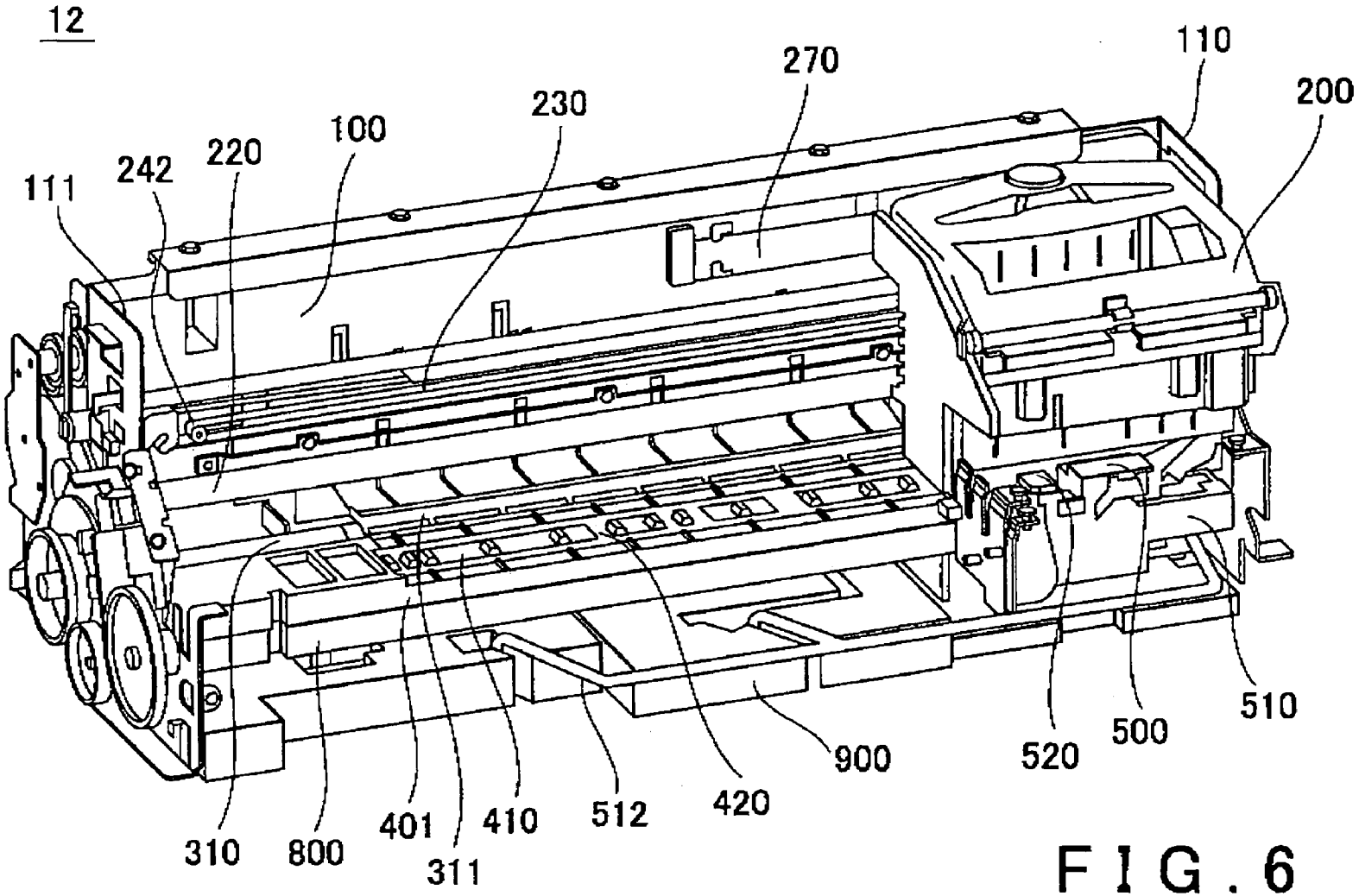
FIG. 6 is a perspective view showing another embodiment of an internal mechanism of an ejecting apparatus shown in FIG. 1.

FIG. 6 is a perspective view showing another embodiment of the internal mechanism 12 of the ink-jet type recording apparatus 11 shown in FIG. 1. In FIG. 6, since the same components as those shown in FIG. 5 have the same reference numerals, their descriptions will be omitted.

In this embodiment, the internal mechanism 12 is also formed inside an area bounded by the frame 100 that is arranged backward and generally vertically and a pair of side face portions 110 and 111 that are extended from both ends of the frame 100 to the front parallel to each other. The carriage 200 is supported by the guide shaft 220 penetrating through the carriage, and thus can horizontally reciprocate along the guide shaft 220. At the back of the carriage 200, the timing belt 230 that is hung on a pair of pulleys 242 (the other is not shown) is coupled to the rear portion of the carriage 200. The carriage 200 can reciprocate according to an operation of the timing belt 230.

Moreover, the platen 400 is arranged on the lower side of an area along which the carriage 200 passes. The platen 400 supports the recording material 300 passing along a bottom of the carriage 200 from the lower side, in order to hold a distance between the nozzle plate 260 and the recording material 300 constant. Moreover, the concavity 410 is formed on the upper face of the platen 400 and the absorbing member 420 is accommodated in the concavity 410. The absorbing member 420 receives ink discharged from the recording head 210 for an area on which the recording material 300 does not exist.

The carrying roller 310 is arranged at the back of the platen 400, and sends the recording material 300 onto the platen 400 in cooperation with a driven roller 311. As described above, the carriage 200 can reciprocate in the direction perpendicular to a transportation direction of the recording material 300. Therefore, the transportation of the recording material 300 and the reciprocation of the carriage 200 can alternately be performed, whereas the recording head 210 on the undersurface of the carriage 200 can intermittently be operated to discharge and attach ink to an arbitrary area on the recording material 300.

Moreover, in the internal mechanism 12, the cap member 500 is arranged at the side face portion 110 near the platen 400. The cap member 500 can move up and down, and thus ascends and seals the surface of the nozzle plate 260 when the carriage 200 stops at the home position near the side face portion 110. Moreover, the wiping means 520 is arranged between the platen 400 and the cap member 500. The wiping means 520 wipes out the lower face of the nozzle plate 260 to clean it when the carriage 200 released from the cap member 500 passes over the wiping means 520. In addition, the inside of the cap member 500 is coupled with the pump unit 510. The pump unit 510 includes the pump motor 511 therein, and can thus absorb ink attached to the surface of the nozzle plate 260 through the cap member 500.

In an embodiment shown in FIG. 6, there is provided an independent absorbing member 900 for accommodating ink absorbed by the cap member 500 and the pump unit 510. That is, a waste liquid absorber accommodated in a holding member 1800 is mounted on the lower side of the absorbing member 420 of the platen 400 side. This waste liquid absorber is insulated by the holding member 1800 having an insulating property from the periphery. Further, another waste liquid absorber 900 is arranged on the lower side of the holding member 1800. The waste liquid absorber 900 can absorb and accommodate the ink, which the pump unit 510 absorbs from the inside of the cap member 500, through the pipe 512.

In addition, a path of ink (waste liquid) from the cap member 500 to the waste liquid absorber 900 of a cap side gets wet by ink having electrical conductivity. Therefore, when the carriage 200 is located at a home position and the cap member 500 seals the nozzle plate 260, all components on the path of ink (waste liquid) including the nozzle plate 260, the cap member 500, the pump unit 510, the pipe 512, and the waste liquid absorber 900 have the same potential. On the other hand, the absorbing member 420 of the platen 400 and the waste liquid absorber accommodated in the holding part 1800 are electrically coupled with each other due to the absorbed ink, and thus both have the same potential. Therefore, when waste liquid of the absorbing member side and waste liquid of the cap side are electrically coupled with each other, the nozzle plate 260 and the absorbing member 420 are short-circuited.

On the other hand, in this embodiment, the waste liquid absorber of the absorbing member 420 side is accommodated in the holding member 1800 with an insulating property, and the waste liquid absorber 900 of the cap member 500 side is arranged outside the holding member 1800. Therefore, both are not electrically coupled with each other, and the nozzle plate 260 and the absorbing member 420 are not short-circuited via the cap member 500 side.

Figure 7:
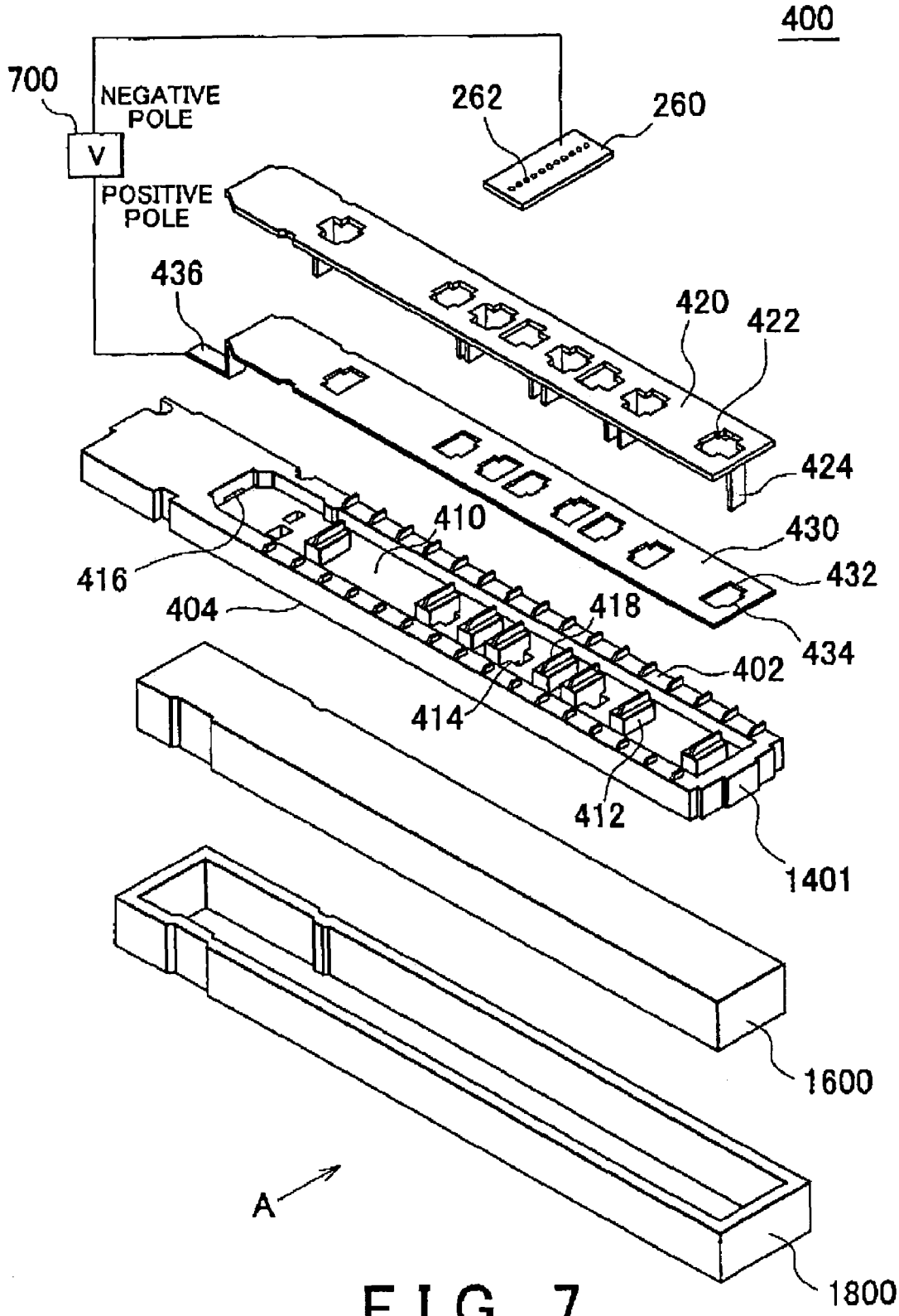
FIG. 7 is an exploded perspective view showing a configuration of a platen that may be used in an ejecting apparatus shown in FIG. 1.

FIG. 7 is an exploded perspective view showing a configuration of the platen 400 including a waste liquid absorber 1600 that may be used in the ink-jet type recording apparatus 11 shown in FIG. 1. In addition, in FIG. 7, since the same components as those shown in FIGS. 1 and 5 have the same reference, numerals, their descriptions will be omitted.

As shown in the present drawing, the platen 400 is formed by superimposing a platen main body 1401 accommodating the electrode 430 and the absorbing member 420 and the holding part 1800 accommodating the waste liquid absorber 1600. Here, the holding part 1800 includes an upper end having: a shape complementary with a bottom face of the platen main body 1401, and can be integrated with the platen main body 1401 in a state that the holding part accommodates the waste liquid absorber 1600. In addition, the holding part 1800 can be formed of injection molded resin in a unified body.

Moreover, the terminal inserting hole 416 for inserting the terminal portion.436 of the electrode member 430 as described below is formed at the end of the bottom face of the concavity 410. Similarly, the foot inserting holes 414 for inserting the foot portions 424 of the absorbing member 420 as described below are also formed in the vicinity of the insular portions 412 on the bottom facer of the concavity 410. The platen main body 1401 including the insular portions 412, the ribs 418, the terminal inserting hole 416, and the foot inserting holes 414 can be formed of injection molded resin in a unified body.

The electrode member 430 is an electric conductor plate having the substantially same shape as that of the bottom face of the concavity 410 on the platen main body 1401, and includes the insular portion inserting holes 432 for inserting the insular portions 412 of the platen main body 1401 and the notches for foot insertion 434 for inserting the foot portions 424 of the absorbing member 420 as described below. Furthermore, the terminal portion 436 for coupling with the potential difference generating means 700 as described below is formed in one end of the electrode member 430. The terminal portion 436 extends from the electrode member.430 to the lower side. Therefore, when the electrode member 430 has been accommodated in the concavity 410, the terminal portion 436 is exposed to the outside of the platen main body 1401 through the terminal inserting hole 416.

The electrode member 430 as described above is formed of metal with corrosion resistance against ink of the ink-jet type recording apparatus 11, for example, wire rod, plate, or foil material of gold, stainless steel, or nickel, or wire rod, plate, or foil material plated with these metals, or a net-like or lattice-like member made by combining these materials. Moreover, as another aspect, the electrode member 430 can be formed of a film layer, a plating layer, a thick film layer, a thin film layer, or the like having electric conductivity, which is directly formed in the concavity of the platen main body 1401.

The platen main body 1401 accommodates the absorbing member 420 inside the concavity 410 in a method overlapping the absorbing member 420 on the electrode member 430. The absorbing member 420 has the substantially same surface configuration as the concavity 410. Moreover, the absorbing member 420 has insular portion inserting holes 422 for inserting the insular portions 412 of the platen main body 1401 at the positions corresponding to the arrangement of insular portions 412.

Furthermore, the absorbing member 420 includes the foot portions 424 respectively extending on the lower side from the edges of the insular portion inserting holes 422. Each foot portion 424 utilizes a part of a portion that becomes unnecessary to form the insular portion inserting hole 422, in order to be formed by downward bending the unnecessary portion after shaping the absorbing member 420. The foot portions 424 are inserted into the notches for foot insertion 434 of the electrode member 430 and the foot inserting holes 414 of the platen main body 1401 to be extended on the lower side of the platen main body 1401, and lower ends of the foot portions contacts with a waste liquid absorbing member 1600 shown in FIG. 5.

In additions the absorbing member 420 directly receives a droplet of ink not attached to the recording material 300 after being discharged from the nozzle plate 260. At this time, when absorption speed of the absorbing member 420 is slow, so-called a milk crown phenomenon occurs due to an impact by which the droplet collides with the surface of the absorbing member 420. A minute droplet occurs on the periphery of a milk crown, and the droplet causes the generation of an aerosol. Thus, a foaming material having high percentage of voids is selected as a material of the absorbing member 420 in serious consideration of the height of absorption speed.

Moreover, the absorbing member 420 can be formed of a conductive material having a resistance value of surface resistance less than or equal to $10^8\Omega$. Specifically, a material made by mixing and foaming a conductive material such as metal and carbon with resin such as polyethylene and polyurethane, a material made by attaching a conductive material such as metal and carbon to a resin foaming material such as polyethylene and polyurethane, or a material made by plating resin can be used as the absorbing member. Moreover, a material made by impregnating a resin foaming material such as polyethylene and polyurethane with an electrolytic solution can be used as the absorbing member 420.

In a series of members shown in FIG. 7, the electrode member 430 is coupled with the nozzle plate 260 through the potential difference generating means 700 as typically shown in the present drawing. Therefore, an electric field, e.g., not less than 25 kV/n is formed between the nozzle plate 260 and the electrode member 430. In a form shown in FIG. 7, a negative pole side of the potential difference generating means 700 is electrically connected to the nozzle plate 260, and a positive pole side of the potential difference generating means 700 is electrically connected to the electrode member 430. However, the positive and negative poles may be connected in a reverse method.

Moreover, since the absorbing member 420 is coupled with the waste liquid absorbing member 1600 through a lot of foot portions 424, ink absorbed into the absorbing member 420 is immediately led to the waste liquid absorbing member 1600 via each foot portion 424. Therefore, a little ink adheres to the electrode member 430 arranged on a lower layer of the absorbing member 420, and thus an electric field of the electrode member 430 side by the adhesion of ink is not almost degraded.

Furthermore, the electrode member 430 covers the substantially whole bottom face of the concavity 410 of the platen main body 1401, and the absorbing member 420 having the generally same shape as the electrode member is superimposed and accommodated thereupon. In this manner, since the whole lower face of the absorbing member 420 touches the electrode member 430, the whole absorbing member 420 has uniform electric potential generally equal to the electrode member 430 even if electrically discontinuous portions are in the internal structure of the absorbing member 420.

Figure 8:
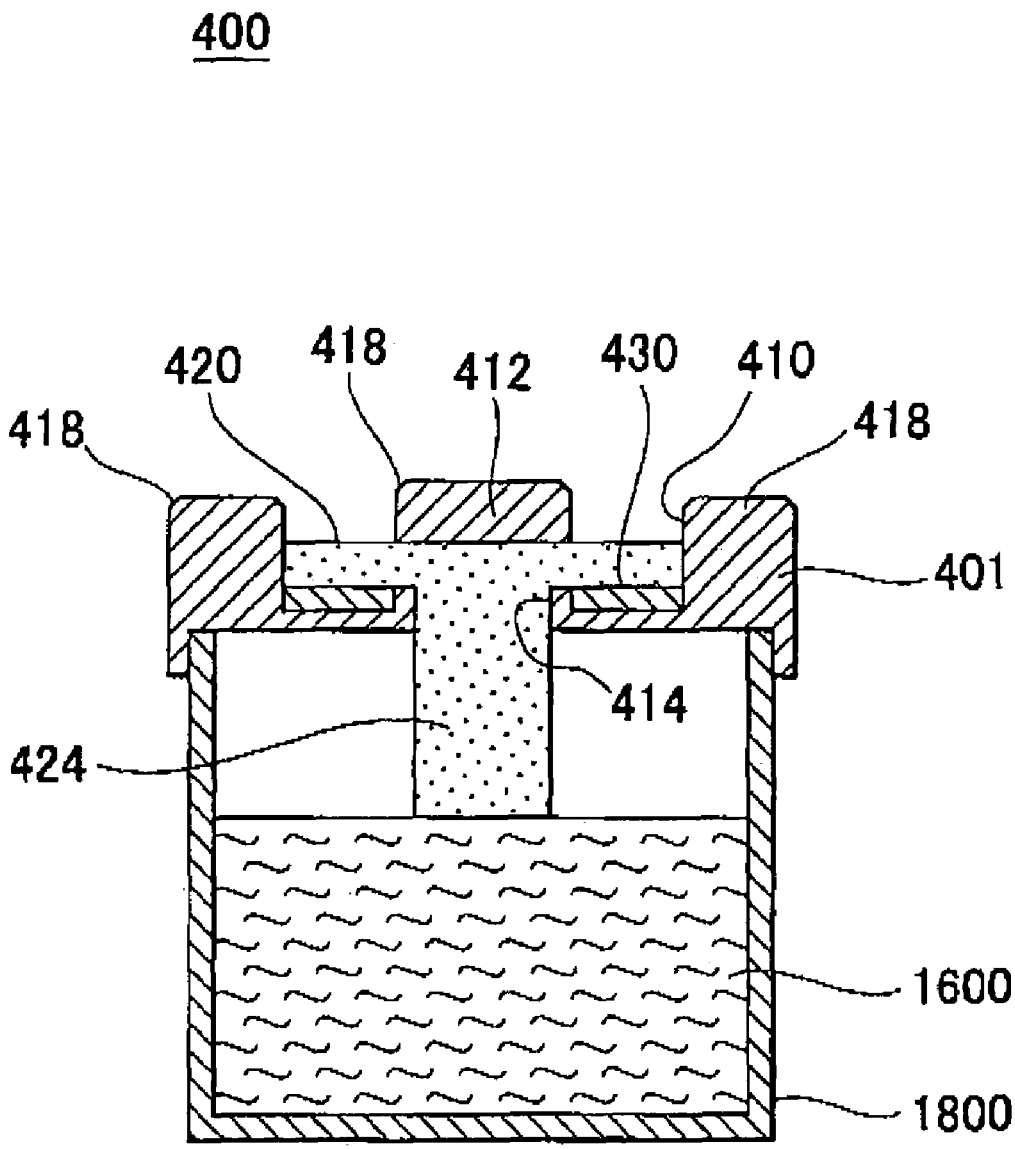
FIG. 8 is a vertical cross-sectional view showing an assembled state of a platen shown in FIG. 7.

FIG. 8 is a sectional view of the platen 400 shown in FIG. 7. That is, FIG. 8 shows a cutting plane obtained by cutting the integrated platen 400 shown in FIG. 7 with a vertical plane including an arrow A in FIG. 7.

As shown in the present drawing, the waste liquid absorber 1600 is sealed in a space bounded by the platen main body 1401 and the holding part 1800 in the state that the platen 400 has been assembled. This space is communicated with the outside only through the foot inserting hole 414 formed on a bottom of the platen main body 1401, and the foot portion 424 of the absorbing member 420 is inserted into the space. Moreover, both the platen main body 1401 and the holding part 1800 are formed of insulating materials. Therefore, ink absorbed into the waste liquid absorber 1600 is not electrically coupled with members outside the platen 400.

That is, in the inside of the ink-jet type recording apparatus 11, parts having an electric potential different from the electrode 430 and ink inside the absorbing member 420 and the waste liquid absorber 1600 exist besides the nozzle plate 260. As a representative example, there are quoted electric and electronic circuits such as the electric circuit 120, the head motor 246, the carrying motor 320, and the pump motor 511. Moreover, most of these electric and electronic circuits are mainly grounded on a metal portion of the frame 100, and electric components around the recording head 210 are also grounded. Further, the ink-jet type recording apparatus 11 utilizes a lot of metal members. As a representative example, a part made of metal is used for the frame 100, the guide shaft 220, and the carrying roller 310. On the other hand, as already described above, ink absorbed into the waste liquid absorber 1600 has an electrical conductivity. Therefore, when this ink intrudes between various kinds of members and the waste liquid absorber 1600, this is equal to the state when the potential difference generating means 700 is short-circuited. However, in the ink-jet type recording apparatus 11 according to the present embodiment, the waste liquid absorber 1600 is electrically sealed by the holding part 1800 that is an insulator. In this way, the waste liquid absorber 1600 is electrically insulated from peripheral members such as the pump motor 511, the frame 100, the head motor 246, the carrying motor 320, and the electronic circuit 120. Thus, short-circuit between the waste liquid absorber 1600 and the peripheral member is prevented.

Figure 9:
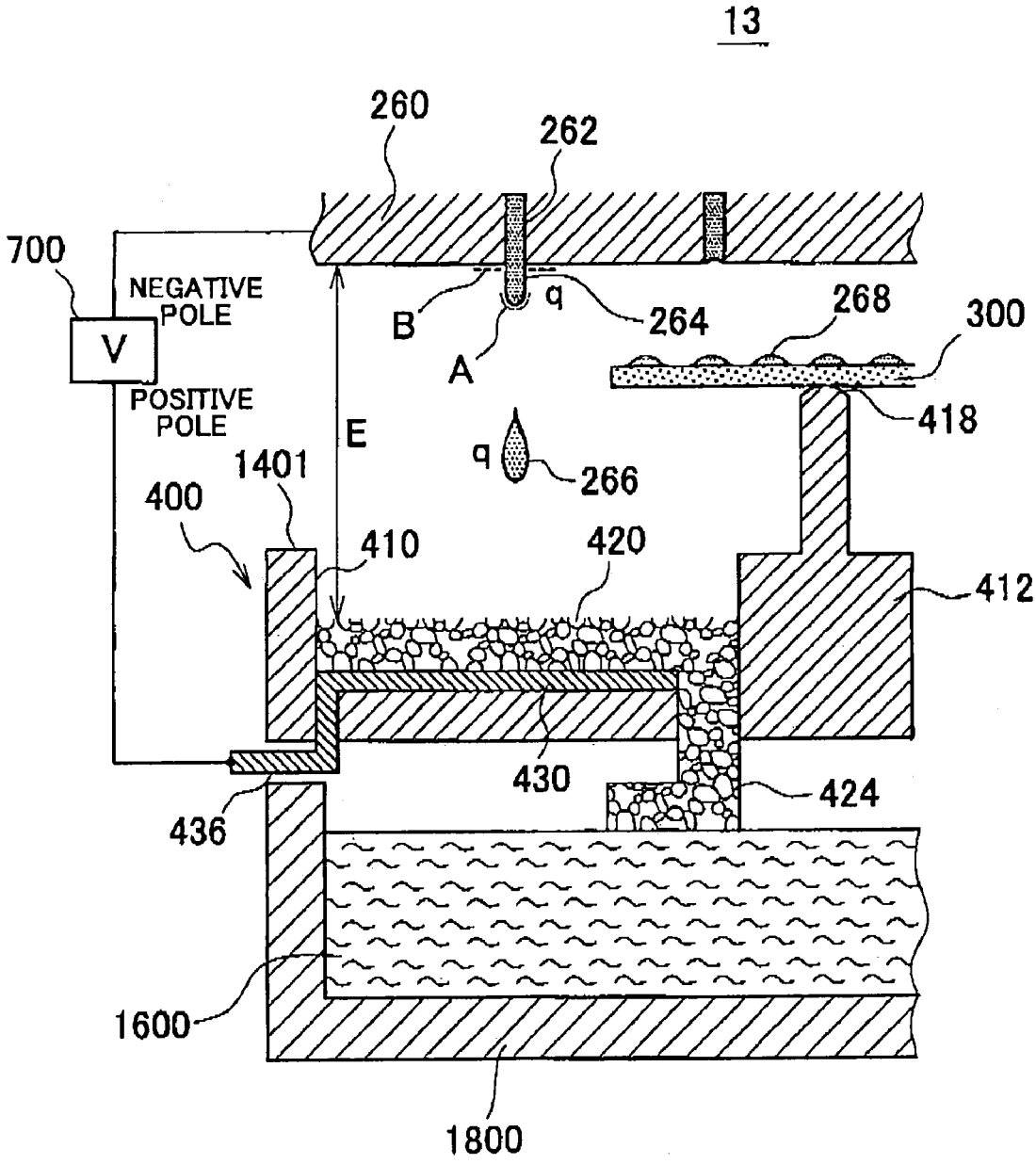
FIG. 9 is a side view enlarging and showing the vicinity of a nozzle plate of an ejecting apparatus shown in FIG. 1.

FIG. 9 is a conceptual diagram showing an aerosol collecting mechanism 13 in the ink-jet type recording apparatus shown in FIGS. 1 and 5 to 8. In FIG. 9, since the same components as those shown in FIGS. 1 and 5 to 8 have the same reference numerals, their descriptions will be omitted.

As shown in the present drawing, the plurality of openings 262 for discharging ink is formed in the nozzle plate 260. In general, the recording material 300 supported by the rib 418 of the platen body 1401 from the lower side exists right under the nozzle plate 260. Therefore, the droplet 268 discharged from the nozzle plate 260 adheres to the recording material 300.

However, when attaching ink to edges of the recording material 300 without white space, in side edges and front and rear ends of the recording material 300, the recording material 300 may not exist right under a part of the openings 262. In this case, a kinetic energy given to the droplet 266 by the discharge from the opening 262 is rapidly lost by viscous resistance of an atmosphere, and a part of the droplet is completely lost a long time before arriving at the absorbing member 420. Moreover, since mass of the droplet 266 is small extremely, a falling motion by acceleration of gravity and the viscous resistance force balance each other, and fall velocity of the droplet 266 becomes extremely late. In this way, there is generated an aerosol floating on the lower side of the nozzle plate 260.

However, in the aerosol collecting mechanism 13 shown in FIG. 9, an electric field E is formed between the nozzle plate 260 and the absorbing member 420. That is, as already described with reference to FIG. 7, in the ink-jet type recording apparatus, one end of the potential difference generating means 700 is connected to the nozzle plate 260, and the other end of the potential difference generating means 700 is connected to the electrode member 430 through the terminal portion 436. Moreover, the whole upper face of the electrode member 430 is in contact with the whole lower face of the absorbing member 420. Further, the absorbing member 420 has electrical conductivity. Therefore, the upper face of the absorbing member 420 has the generally same potential as that of the electrode member 430, and further the potential is uniform overall.

The ink pushed out from the opening 262 in the ink-jet type recording apparatus 11 becomes the ink pillar 264 drooping from the nozzle plate 260 at the moment just before the ink becomes the droplet 266. At this time, there is generated so-called lightning conductor effect at the leading end A. That is, the above lightning conductor effect means that the area on the surface of the nozzle plate 260 surrounded with a conical shape including a range of a vertex angle, from 50° to 60° with the leading end A (a lower end in the present drawing) of the ink pillar 264 at the top contributes to the charge of the droplet 266. By this lightning conductor effect, the droplet 266 is charged with an electric charge larger than an electric charge corresponding to a horizontal cross sections of the ink pillar 264.

The ink pillar 264 becomes the droplet 2.66 apart from the nozzle plate 260 before long. However, this droplet 266 is charged with an electric charge q accumulated by the lightning conductor effect as described above. Therefore, the droplet 266 having the charge q obtains a kinetic energy by a coulomb force Fe (qE) from an electric field E, and thus moves on the lower side without deceleration to finally arrive at the absorbing member 420.

Further, the absorbing member 420 communicates with the waste liquid absorber 1600 over the foot portion 424. Therefore, ink absorbed into the absorbing member 420 is sequentially absorbed into the waste liquid absorber 1600. Here, the periphery of the waste liquid absorber 1600 is surrounded by the holding part 1800 that is an insulator. Therefore, ink absorbed into the waste liquid absorber 1600 is not electrically coupled with the other parts inside the ink-jet type recording apparatus 11.

Figure 10:
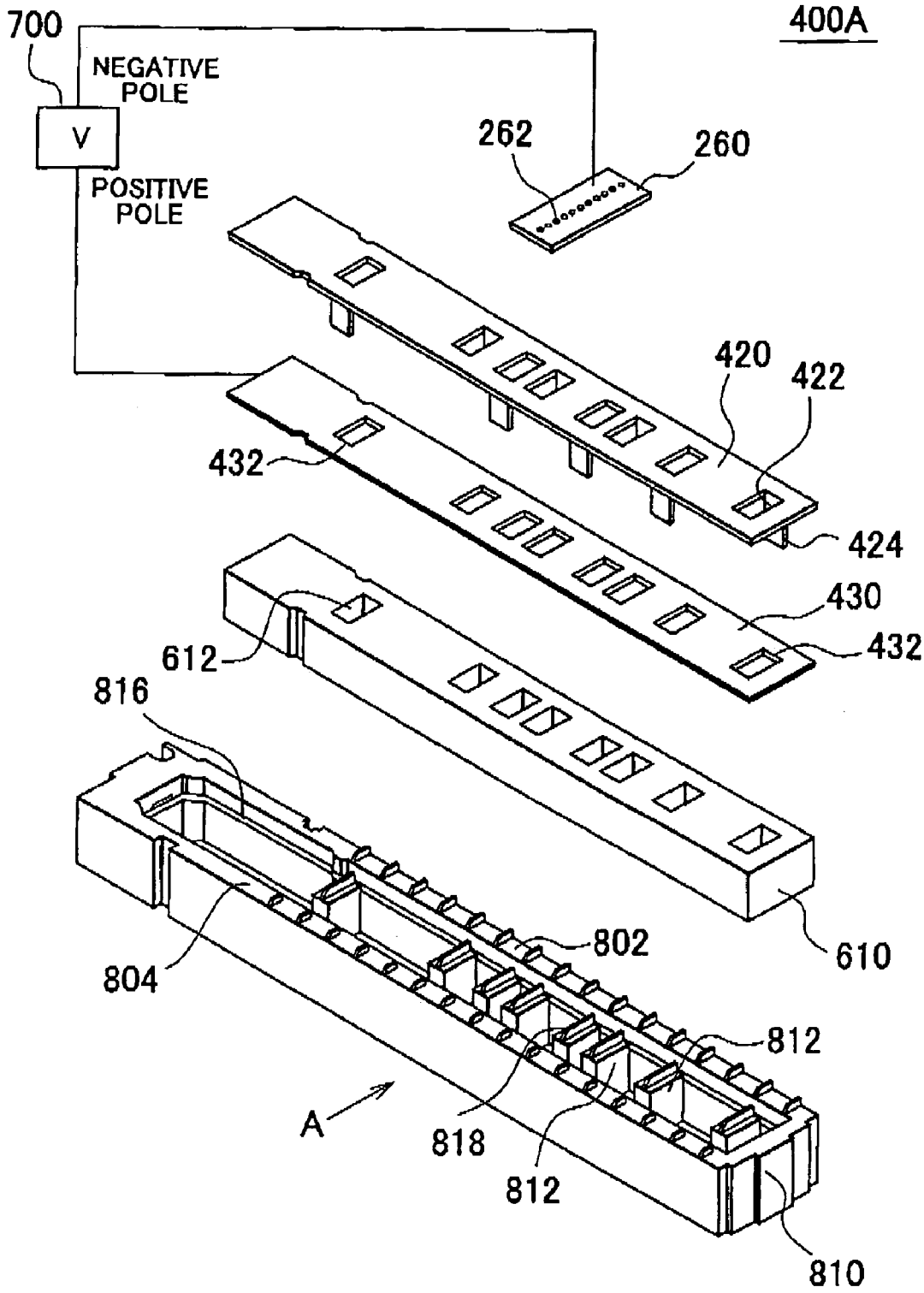
FIG. 10 is a perspective view showing another form of a platen that may be used in an ejecting apparatus shown in FIG. 1.

FIG. 10 is an exploded perspective view showing a configuration of a platen 400A including a waste liquid absorber 610 that may be used in the ink-jet type recording apparatus 11 shown in FIG. 1. In FIG. 10, since the same components as those shown in FIGS. 1 to 9 have the same reference numerals, their descriptions will be omitted.

As shown in the present drawing, in this embodiment, the platen main body 1401 is omitted to reduce the number of parts. However, insular portions 812 are formed on a bottom of a holding part 810 in order to support the recording material 300 in place of the insular portions 412 of the platen main body 1401. Moreover, ribs 818 for supporting the recording material 300 are formed on edge 802 and 804 of the holding part 810 corresponding to the front and the rear in a transportation direction of the recording material 300. Further, insular portion inserting holes 612 are formed on the waste liquid absorber 610 accommodated in this holding part 810. Moreover, a step 816 for supporting the electrode member 430 in a predetermined height is formed on an inner face, of a side wall of the holding part 810. In addition, this holding part 810 can be formed of injection molded resin in a unified body along with the insular portions 812 and the ribs 818.

Figure 11:
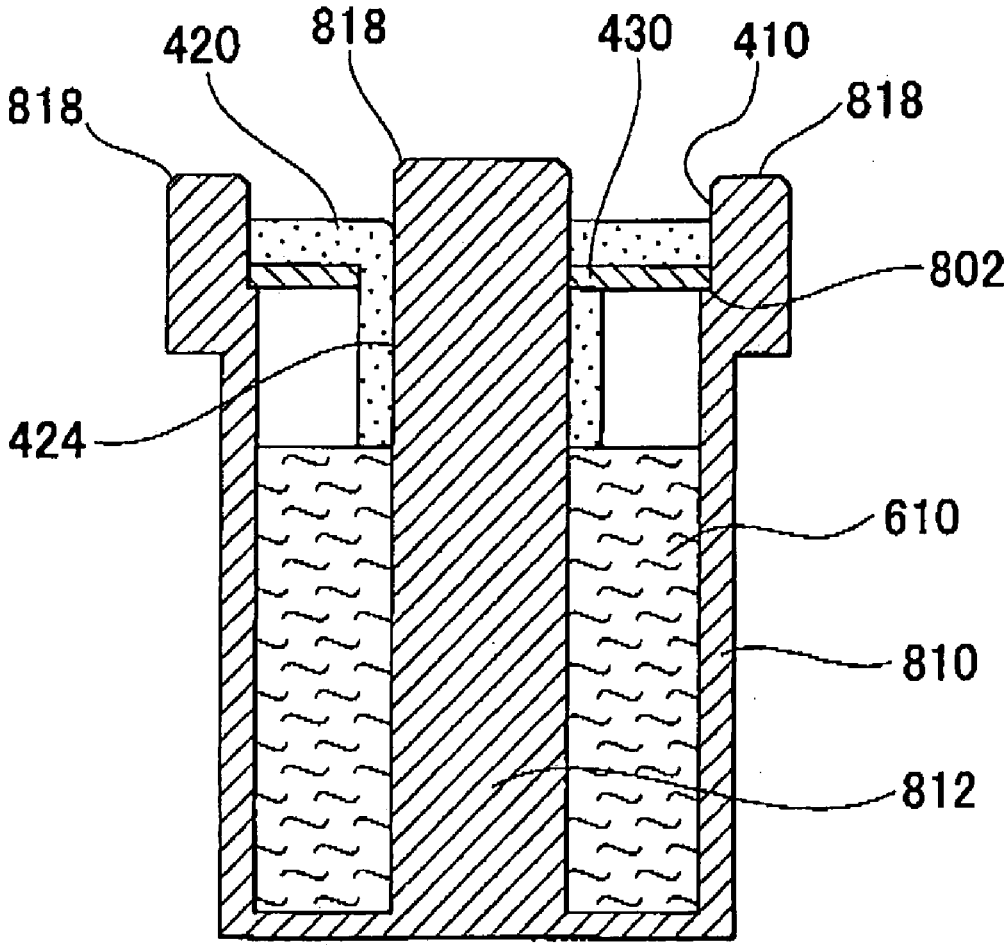
FIG. 11 is a vertical cross-sectional view showing an assembled state of a platen shown in FIG. 10.

FIG. 1 is a sectional view of the platen 400A shown in FIG. 10. That is, FIG. 11 shows a cutting plane obtained by cutting the integrated platen 400A shown in FIG. 10 with a vertical plane including an arrow A in FIG. 10.

As shown in the present drawing, the waste liquid absorber 610 is sealed in a space bounded by the holding part 810 and the electrode member 430 in the state that the platen 400A has been assembled. This space is communicated with the outside only through the insular portion inserting hole 432 formed on the electrode member 430, and the foot portion 424 of the absorbing member 420 is inserted into the insular portion inserting hole 432. Moreover, the holding part 810 is formed of insulating materials and the surface of the electrode member 430 is covered with the absorbing member 420. Therefore, ink absorbed into the waste liquid absorber 610 is not electrically coupled with the other members inside the ink-jet type recording apparatus 11.

Figure 12:
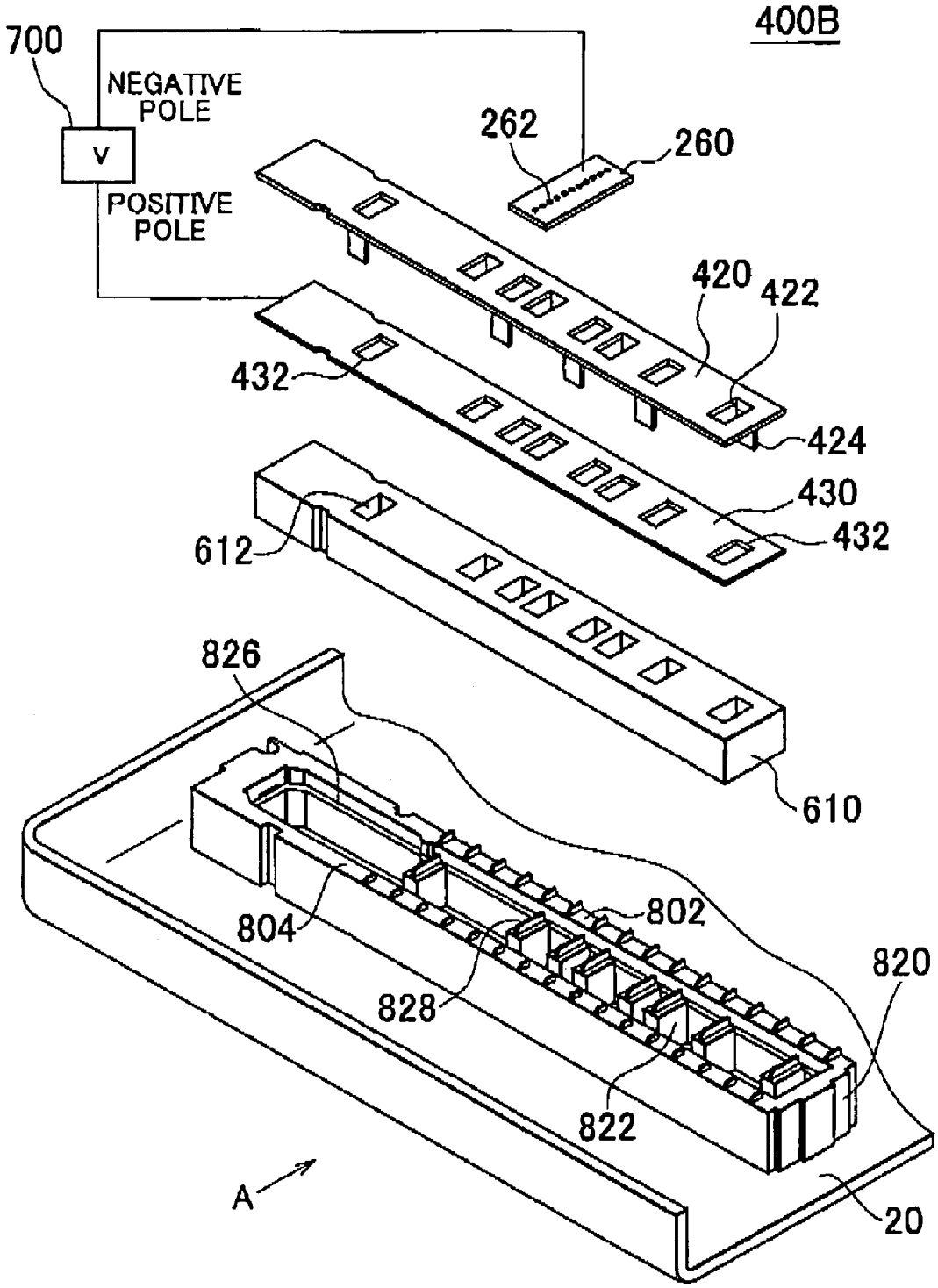
FIG. 12 is a perspective view showing further another form of a platen that may be used in an ejecting apparatus shown in FIG. 1.

FIG. 12 is an exploded perspective view showing a configuration of a platen 400B including the waste liquid absorber 610 that may be used in the ink-jet type recording apparatus 11 shown in FIG. 1. In FIG. 12, since the same components as those shown in FIGS. 1 to 9 have the same reference numerals, their descriptions will be omitted.

As shown in the present drawing, in this embodiment, it is characterized that a holding part 820 having the same shape as that of the platen 400A shown in FIG. 10 is integrated with the bottom case 20 of the ink-jet type recording apparatus 11 in a unified body. By such a configuration, not only the number of parts is reduced, but also the number of assembly processes is reduced. In addition, this holding part 820 can be formed of injection molded resin in a unified body along with insular portions 822 and ribs 828 and the bottom case 20.

Figure 13:
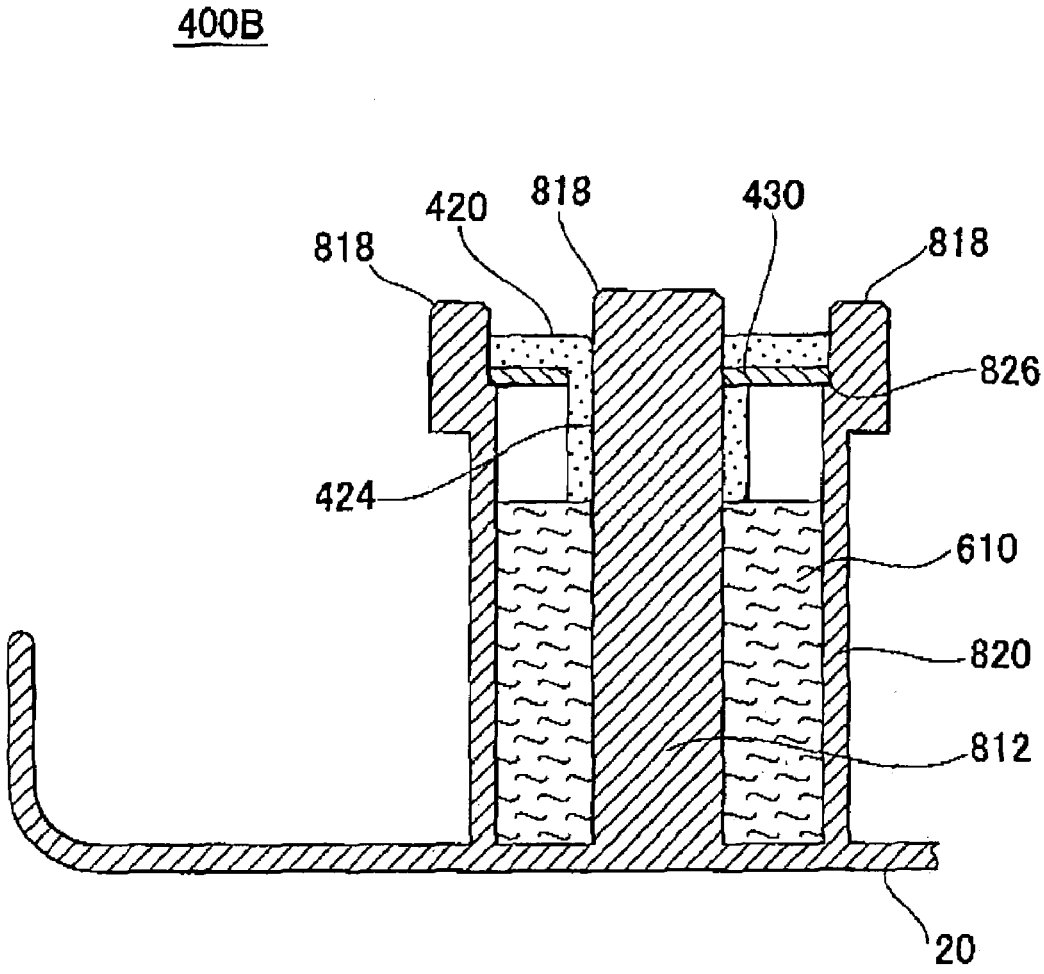
FIG. 13 is a vertical cross-sectional view showing an assembled state of a platen shown in FIG. 12.

FIG. 13 is a sectional view of a member shown in FIG. 12. That is, FIG. 13 shows a cutting plane obtained by cutting the integrated member shown in FIG. 12 with a vertical plane including an arrow A in FIG. 12.

As shown in the present drawing, the waste liquid absorber 610 is sealed in a space bounded by a holding part 820 and the electrode member 430 in the state that the platen 400B has been assembled. This space is communicated with the outside only through the insular portion inserting hole 432 formed on the electrode member 430, and is inserted into the foot portion 424 of the absorbing member 420. Moreover, the holding part 820 is formed of insulating materials and the surface of the electrode member 430 is covered with the absorbing member 420. Therefore, ink absorbed into the waste liquid absorber 610 is not electrically coupled with the other members inside the ink-jet type recording apparatus 11. Moreover, in this configuration, since the height from a lower face of the bottom case 20 to the uppermost part of the platen 400B can be controlled this is contributed to miniaturization of the ink-jet type recording apparatus 11.

In this manner, a constant voltage may be applied to the absorbing member side of the liquid ejecting apparatus in order to form an electric field for collecting aerosols. Moreover, liquid itself absorbed into the waste liquid absorber has electrical conductivity, and has the same potential as that of the absorbing member. On the other hand, many members having the potential different from that of the absorbing member side exist inside the liquid ejecting apparatus. On this account, when liquid absorbed into the waste liquid absorber touches the other members inside the ejecting apparatus, the potential of the absorbing member varies and thus a liquid collecting function by an electric field deteriorates. On the other hand, in the liquid ejecting apparatus according to the present invention, since the waste liquid absorber is accommodated in the holding part that is formed of an insulator, liquid does not touch the other members inside the liquid ejecting apparatus. Therefore, the potential of the absorbing member is stable and an expected performance for collecting aerosols is stably held.

Figure 14:
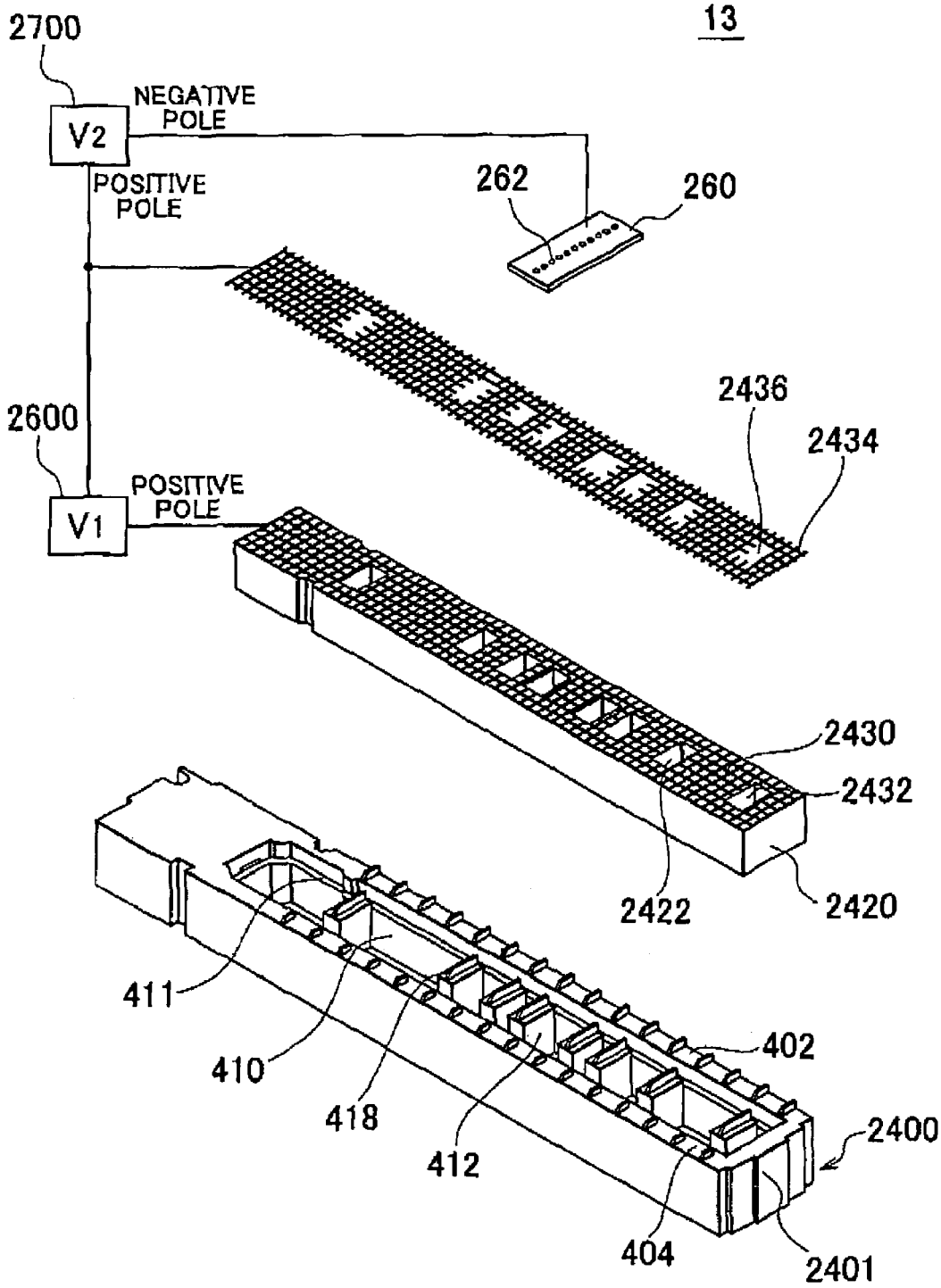
FIG. 14 is a perspective view showing a configuration of an aerosol collecting mechanism of a liquid ejecting apparatus shown in FIG. 1.

FIG. 14 is an exploded perspective view showing a configuration of the aerosol collecting mechanism 13 that may be used in the ink-jet type recording apparatus 11 shown in FIG. 1. Moreover, FIG. 14 also shows electric relation between a terminal electrode 2430 to be described below and an intermediate electrode 2434 and the nozzle plate 260. In addition, in FIG. 14, since the same components as those shown in FIGS. 1 and 2 have the same reference numerals, their descriptions will be omitted. As shown in the present drawing, this platen 2400 includes a platen main body 2401 having a deep concavity 410, and a waste liquid absorber 2420, the terminal electrode 2430, and the intermediate electrode 2434 accommodated in the concavity 410.

The waste liquid absorber 2420 and the terminal electrode 2430 have the substantially same shape and dimension as those of a bottom of the concavity 410, and are superimposed and accommodated inside the concavity 410 at the position lower than the step 411. On the other hand, the intermediate electrode 2434 is more slightly than the terminal electrode 2430, and is accommodated in the step 411 by supporting a peripheral border on the step.

In addition, insular portion inserting holes 2422, 2432, and 2436 for inserting the insular portions 412 of the platen main body 2401 are respectively formed on the waste liquid absorber 2420, the terminal electrode 2430, and the intermediate electrode 2434. Moreover, when ink is absorbed by operations of the ink-jet type recording apparatus, the waste liquid absorber 2420 expands to increase the height. At this time, in an initial state, an enough gap, specifically a gap of around 5 to 10 mm is provided between the terminal electrode 2430 and the intermediate electrode 2434, so that the terminal electrode 2430 and the intermediate electrode 2434 do not touch each other. Moreover, paper pulp or synthetic fiber or a material containing water-absorbing resin in them can be used as a material of the waste liquid absorber 2420.

Further; as typically show in FIG. 14, a terminal potential difference generating means 2600 and an intermediate potential difference generating means 2700 are serially connected to each other. One end of the terminal potential difference generating means 2600 is electrically connected to the terminal electrode 2430, and one end of the intermediate potential difference generating means 2700 is electrically connected to the nozzle plate 260 having a plurality of openings 262. Moreover, the other end of the terminal potential difference generating means 2600 and the other end of the intermediate potential difference generating means 2700 are electrically connected to each other, and further are connected to the intermediate electrode 2434. The terminal potential difference generating means 2600 generates a potential difference $V_1$ between the terminal electrode 2430 and the intermediate electrode 2434.in a direction in which a potential is higher than that of the terminal electrode 2430 side. Moreover, the intermediate potential difference generating means 2700 generates a potential difference $V_2$ between the intermediate electrode 2434 and the nozzle plate 260 in a direction in which a potential is higher than that of the intermediate electrode 2434 side. Moreover, it is preferable that the potential of the nozzle plate 260 is a ground potential or an electronegative potential. The relation of a potential difference will further be explained using FIG. 15.

Figure 15:
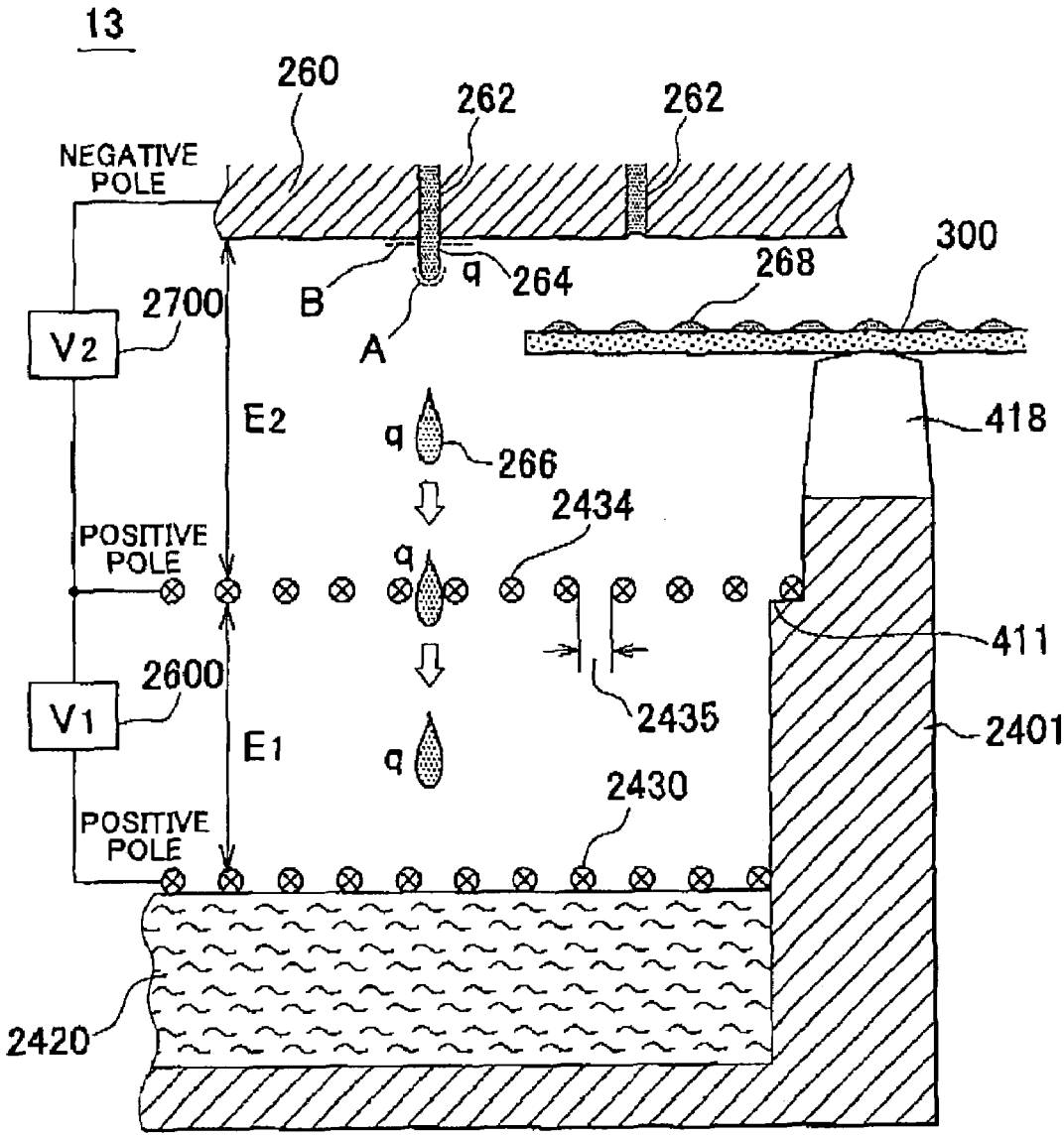
FIG. 15 is a side view enlarging and showing the vicinity of a nozzle plate of a liquid ejecting apparatus.

FIG. 15 is a conceptual diagram typically enlarging and showing the periphery of the nozzle plate 260 during an operation in the aerosol collecting mechanism 13 shown in FIG. 14. In FIG. 15, since the same components as those of FIGS. 1 to 14 have the same reference numerals, their descriptions will be omitted.

As shown in the present drawing, the plurality of openings 262 for discharging ink is formed in the nozzle plate 260. The recording material 300 supported by the rib 418 of the platen body 2401 from the lower side exists right under the nozzle plate 260. Therefore, the droplet.268 discharged from the nozzle plate 260 adheres to the recording material 300.

However, when attaching ink to edges of the recording material 300 without white space, in side edges and front and rear ends of the recording material 300, the recording material 300 may not exist right under a part of the openings 262. In this case, a kinetic energy given to the droplet 266 by the discharge from the opening 262 is rapidly lost by viscous resistance of an atmosphere, and a part of the droplet is completely lost a long time before arriving at the waste liquid absorber 2420. Moreover, since mass of the droplet 266 is small extremely, a falling motion by acceleration of gravity and the viscous resistance force balance each other, and fall velocity of the droplet 266 becomes extremely late. In this way, there is generated an aerosol floating on the lower side of the nozzle plate 260.

The ink pushed out from the opening 262 in the aerosol collecting mechanism 13 becomes an ink pillar 264 drooping from the nozzle plate 260 at the moment just before the ink becomes the droplet 266. At this time, there is generated so-called lightning conductor effect between a leading end A of the ink pillar 264 and the lower face of the nozzle plate 260 on an area B in the vicinity of the ink pillar 264. That is, the above lightning conductor effect means that the area B on the surface of the nozzle plate 260 surrounded with a conical shape including a range of a vertex angle from 50° to 60° with the leading end A (a lower end in the present drawing) of the ink pillar 264 at the top contributes to the charge of the droplet 266. By this lightning conductor effect, the droplet 266 is charged with an electric charge larger than an electric charge corresponding to a horizontal cross section of the ink pillar 264.

The ink pillar 264 becomes the droplet 266 apart from the nozzle plate 260 before long. However, this droplet 266 is charged with an electric charge q accumulated by the lightning conductor effect as described above. On the other hand, in the aerosol collecting mechanism 13 shown in FIG. 15, an electric field $E_2$ is first formed by the potential difference $V_2$ applied between the nozzle plate 260 and the intermediate electrode 2434. Therefore, the droplet 266 having the charge q obtains a kinetic energy by a coulomb force Fe (qE) from an electric field E, and thus moves toward the intermediate electrode 2434 without deceleration.

Further, in the aerosol collecting mechanism 13, an electric field $E_1$ is formed between the intermediate electrode 2434 and the terminal electrode 2430 by the potential difference $V_1$ applied between the intermediate electrode 2434 and the terminal electrode 2430. Here, as described above, the droplet. 266 acquires a kinetic energy by the electric field $E_2$ in the course of flying toward the intermediate electrode 2434. On this account, although Coulomb force given to the droplet 266 by the electric field $E_1$ is smaller than Coulomb force based on the electric field $E_2$, the droplet 266 passes through a transit area 2435 to move toward the terminal electrode 2430 without adhering to the intermediate electrode 2434, and is finally attached and absorbed into the waste liquid absorber 2420. Moreover, since the intermediate electrode 2434 is arranged at a position comparatively near to the nozzle plate 260, the voltage $V_2$ applied to form the electric field $E_2$ can also be reduced compared with the case of the absence of terminal electrode 2430. In accordance with the above, in a form shown in FIG. 15, the potential difference $V_1$ generated by the terminal potential difference generating means 2600 between the terminal electrode 2430 and the intermediate electrode 2434 is smaller than the potential difference $V_2$ generated by the intermediate potential difference generating means 2700 between the intermediate electrode 2434 and the nozzle plate 260.

In addition, if only the terminal electrode 2430 arranged on the surface of the waste liquid absorber 2420 distant from the nozzle plate 260 collects aerosols without the intermediate electrode 2434, an extremely powerful electric field must be formed in order to activate enough Coulomb force on aerosols generated in the neighborhood of the nozzle plate 260. Assuming that there is not the intermediate electrode 2434, there is required a voltage of around three times of a voltage to be applied between the intermediate electrode 2434 and the nozzle plate 260 in the ink-jet type recording apparatus 11 according to the present embodiment.

Moreover, if only the intermediate electrode 2434 arranged at a position comparatively near to the nozzle plate 260 collects aerosols without the terminal electrode 2430, a part of the droplet 266 charged with the electric charge q does not pass through the transit area 2435 and gradually adheres to the intermediate electrode 2434, so as to be an insulator by deposition and cover the surface of the intermediate electrode 2434. Further, when a part of the droplet 266 charged with the electric charge q does not pass through the transit area 2435 and adheres to the intermediate electrode 2434, it is difficult to stably collect aerosols for long periods because the electric charge q of the charged droplet 266 shields the electric field $E_2$.

In a form shown in FIG. 15, an electric field formed between the nozzle plate 260 and the intermediate electrode 2434 can be not less than 25 kV/m, and an electric field formed between the intermediate electrode 2434 and the terminal electrode 2430 tan be the level of 10 kV/m. Moreover, since the waste liquid absorber 2420 is arranged at a position sufficiently distant from the recording material 300, aerosols do not arrive at the recording material 360 to adhere to the material 300 even if aerosols by a milk crown phenomenon are generated on the surface. Therefore, a material can be selected in serious consideration of a magnitude of an absorptive capacity than rapidity of absorption speed of ink.

In addition, materials of the intermediate electrode 2434 and the terminal electrode 2430 can include metal with corrosion resistance against ink of the ink-jet type recording apparatus, e.g. gold, stainless steel or nickel, or a material obtained by plating these metals on copper. Moreover, members used in the intermediate electrode 2434 can include a member made by parallel arranging wire rod with a diameter of around 0.08 to 0.3 mm formed of these materials at intervals of around 0.6 mm to 2 mm or a member made by combining them in a reticular pattern. Further, members used in the terminal electrode 2430 can include a member made by parallel arranging wire rod with, a diameter of around 0.1 to 0.5 mm formed of these materials at intervals of around 0.5 mm to 4 mm or a member made by combining them in a reticular pattern. Moreover, it is preferable that the intermediate electrode 2434 has the large transit area 2435 to pass a droplet.

Figure 16:
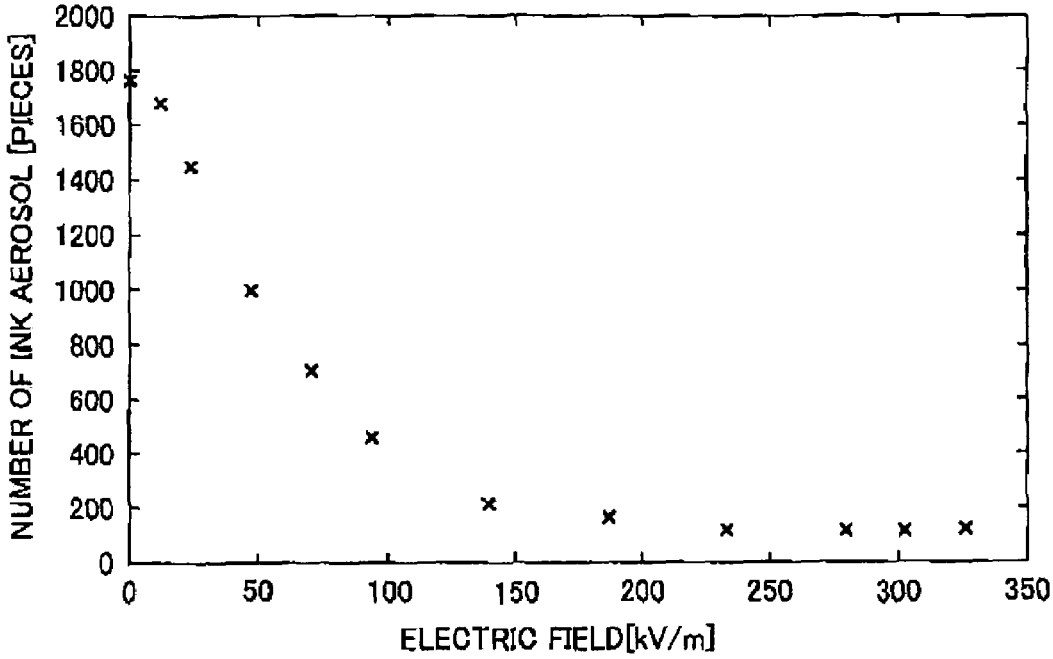
FIG. 16 is a graphic chart showing relation between the number of generated aerosols and the intensity of electric field in a liquid ejecting apparatus.

FIG. 16 is a graphic chart showing relation between an applied electric field and a generation amount of aerosol in the ink-jet type recording apparatus 11 as described above. In addition, the electric field $E_1$ between the intermediate electrode 2434 and the terminal electrode 2430 is fixed to 10 kV/m. On the other hand, the ink-jet type recording apparatus 11 is operated after forming the electric field $E_2$ with various intensities between the intermediate electrode 2434 and the nozzle plate 260, and the drawing has been plotted by measuring a generation amount of aerosol generated according to this. When measuring the amount, the recording operation has been performed on five pieces of recording material using the droplet having particle size of 7 pl for seven minutes 38 seconds from the start of printing, and the result obtained by dividing the total number of aerosols capable of being counted till eight minutes pass after the start of printing by eight becomes the number of aerosols per one minute. As shown in the present drawing, the number of aerosols begins to decrease conspicuously when the electric field exceeds 25 kV/m compared with 1,800 aerosols generated when the electric field $E_2$ does not exist at all.

Figure 17:
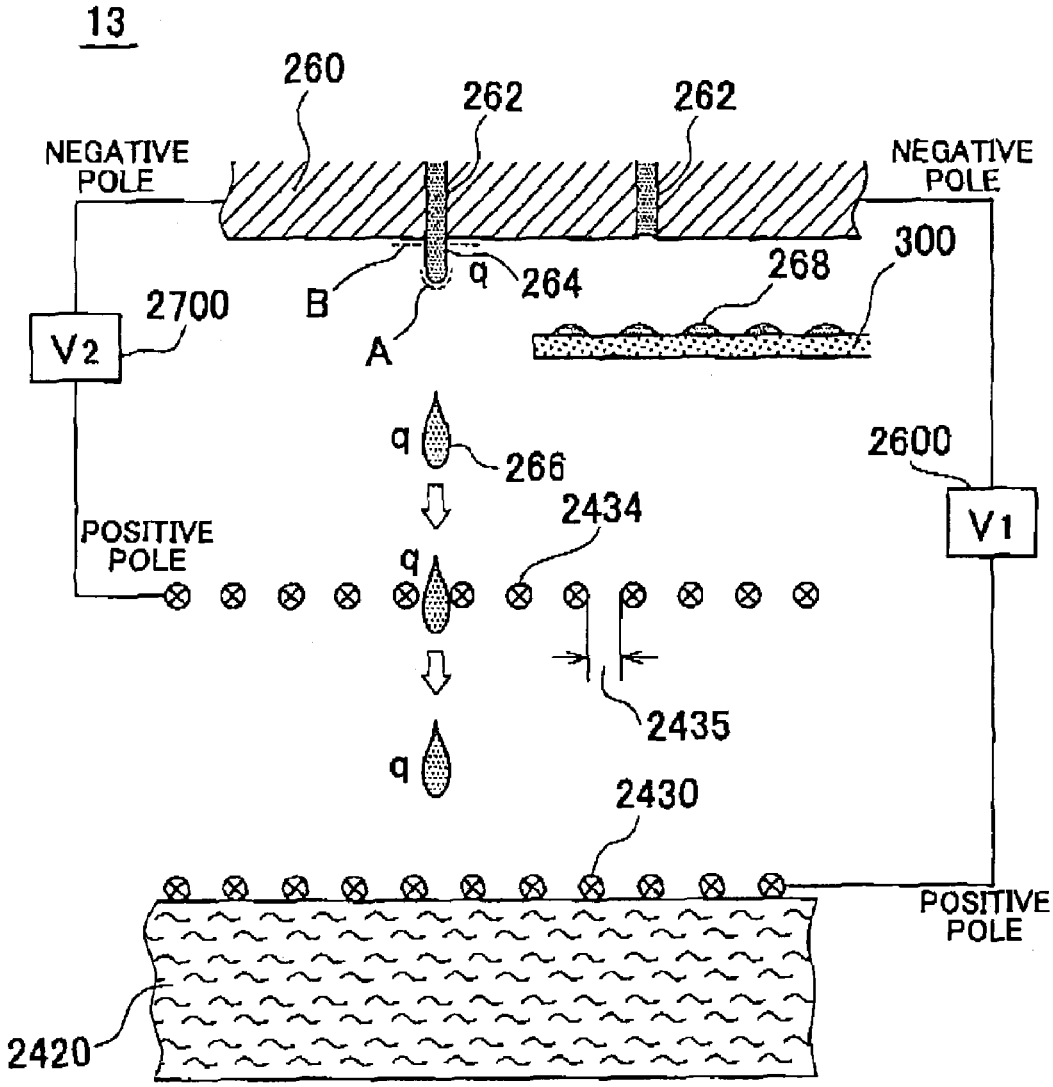
FIG. 17 is a view typically showing another embodiment.

FIG. 17 shows a view typically showing a configuration of the aerosol collecting mechanism 13 that is another embodiment. In addition, FIG. 17 is drawn in response to FIG. 15, and mainly characterizes connection relation of the potential difference generating means 2600 and 2700.

That is, in this embodiment, the intermediate potential difference generating means 2700 is connected between the nozzle plate 260 and the intermediate electrode 2434 similarly to an embodiment shown in FIG. 15. On the contrary, the terminal potential difference generating means 2600 is connected between the nozzle plate 260 and the terminal electrode 2430. By such a configuration, the intermediate potential difference generating means 2700 and the terminal potential difference generating means 2600 are hard to affect each other, and thus stability of an electric field increases.

Figure 18:
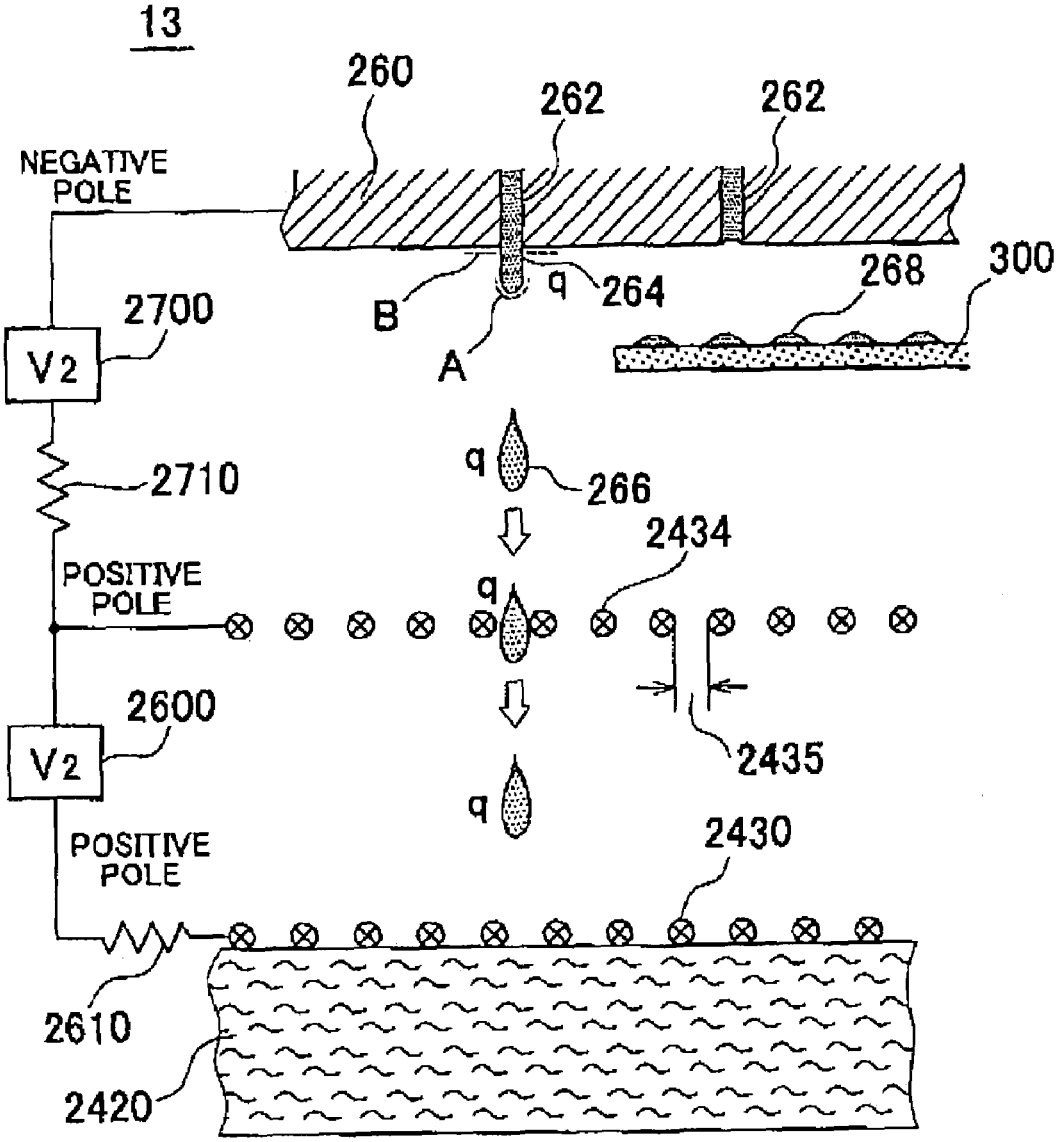
FIG. 18 is a view typically showing an alternative embodiment of an embodiment shown in FIG. 15.

FIG. 18 shows the aerosol collecting mechanism 13 as further another embodiment of the ink-jet type recording apparatus shown in FIG. 15. As shown in the present drawing, this embodiment includes short protecting resistors 2610 and 2710 in addition to components of an embodiment shown in FIG. 15. That is, in this embodiment, the intermediate electrode 2434 is coupled with the nozzle plate 260 via the short protecting resistor 2710 and the intermediate potential difference generating means 2700. Moreover, the terminal electrode 2430 is coupled with the nozzle plate 260 via the short protecting resistor 2610 and the terminal potential difference generating means 2600.

Each of the short protecting resistors 2610 and 2710 prevents excessive currents from flowing into the circuit when either of the nozzle plate 260 and the intermediate electrode 2434 or the nozzle plate 260 and the terminal electrode 2.430 is short-circuited by some sort of reason. Such a short may happen when the recording material 300 is jammed between the nozzle plate 260 and the platen 2400 or a thing or a hand is carelessly put inside the ink-jet type recording apparatus. Further, in this embodiment, even when the intermediate electrode 2434 and the terminal electrode 2430 are short-circuited by some sort of reason, an action of the short protecting resistors 2610 and 2710 can prevent excessive currents from flowing between both.

Figure 19:
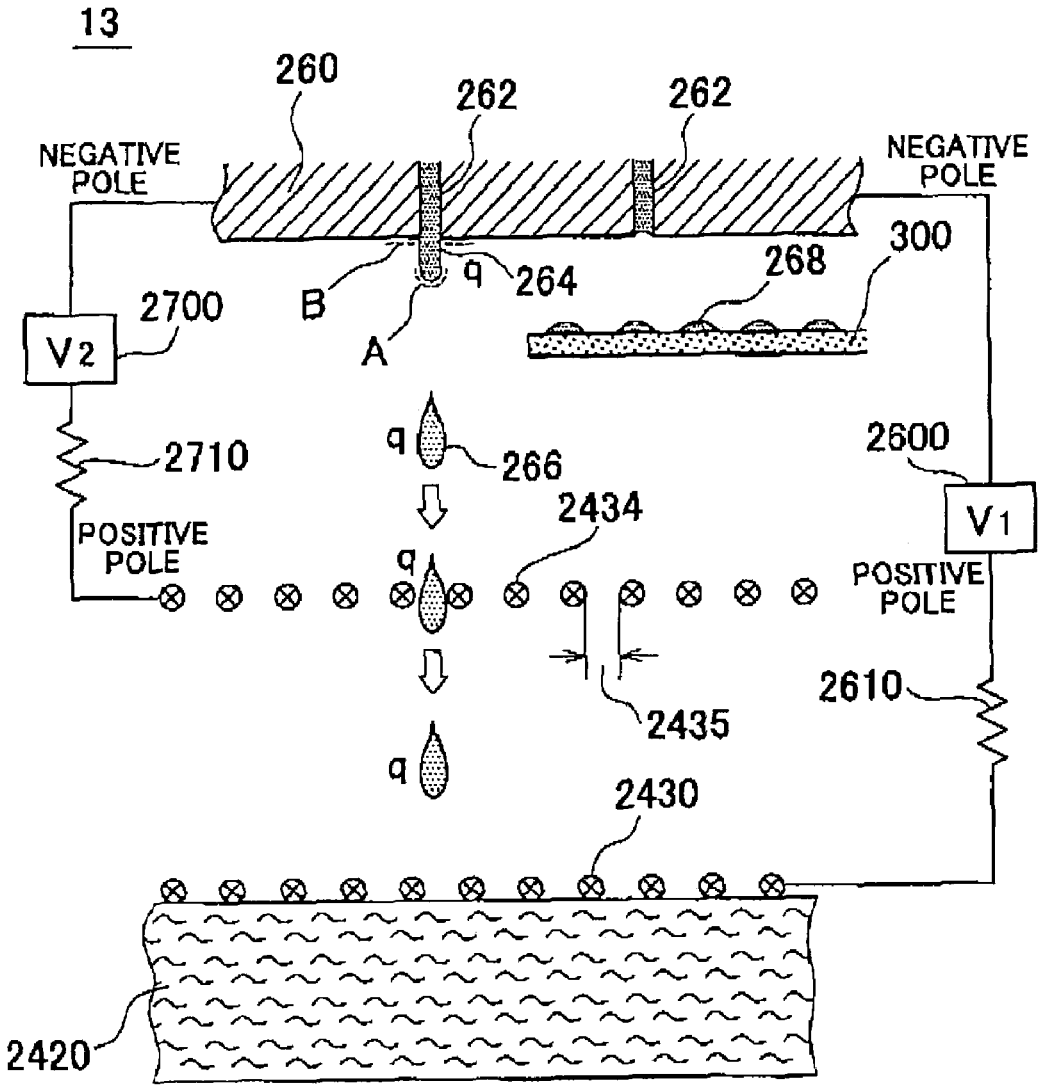
FIG. 19 is a view typically showing an alternative embodiment of an embodiment shown in FIG. 17.

FIG. 19 shows the aerosol collecting mechanism 13 as further another embodiment of the ink-jet type recording apparatus shown in FIG. 17. As shown in the present drawing, this embodiment includes the short protecting resistors 2610 and 2710 in addition to components of an embodiment shown in FIG. 17. That is, in this embodiment, the intermediate electrode 2434 is coupled with the nozzle plate 260 via the short protecting resistor 2710 and the intermediate potential difference generating means 2700. Moreover, the terminal electrode 2430 is coupled with the nozzle plate 260 via the short protecting resistor 2610 and the terminal potential difference generating means 2600.

In this embodiment, as described above, since outputs of the intermediate potential difference generating means 2700 and the terminal potential difference generating means 2600 are separated from each other, both do not affect each other and thus each electric field is stable. Moreover, each of the short protecting resistors 2610 and 2710 prevents excessive currents from flowing into the circuit when either of the nozzle plate 260 and the intermediate electrode 2434 or the nozzle plate 260 and the terminal electrode 2430 is short-circuited by some sort of reason.

As discussed in detail above, the liquid ejecting apparatus according to an embodiment of the present invention realizes stable operations for long periods by combining the intermediate electrode for forming an electric field to supply a kinetic energy to floating aerosols and the terminal electrode for guiding aerosols induced to the intermediate electrode to the absorbing member, in order to reduce adhesion of liquid to the intermediate electrode. In this way, since a collection function of aerosols effectively operates over a long time, recording material, a liquid ejecting apparatus itself, a periphery of the liquid ejecting apparatus, a band of a user operating the liquid ejecting apparatus, or the like is not polluted by aerosols.

Although the present invention has been described by way of an exemplary embodiment, it should be understood that those skilled in the art might make many changes and substitutions without departing from the spirit and the scope of the present invention. It is obvious from the definition of the appended claims that embodiments with such modifications also belong to the scope of the present invention.

Moreover, as an operative example of a liquid ejecting apparatus that may be an embodiment of the present invention, although the liquid ejecting apparatus can include a color material injection system in manufacture of a color filter for a liquid crystal display, an electrode formation apparatus in manufacture of an organic EL display, FED (a plane emission display), or the like, or a sample injection head used in manufacture of a biochip, the liquid ejecting apparatus is not limited to them.

What is claimed is:

1. A liquid ejecting apparatus comprising:

a liquid ejecting head that has a conductive nozzle plate and discharges liquid from openings of the nozzle plate to recording material;

an absorbing member that is arranged opposite the nozzle plate in a direction in which the liquid is discharged and has electrical conductivity to absorb liquid not attached to the recording material;

an electrode that is electrically connected to a rear face of said absorbing member opposite a face facing the nozzle plate; and a potential difference generating means that generates a potential difference between the nozzle plate and said electrode to electrically attract the liquid toward said electrode.

2. The liquid ejecting apparatus as claimed in claim 1, wherein said electrode is continuously formed over the rear face of said absorbing member in a substantially planar shape.

3. The liquid ejecting apparatus as claimed in claim 1, wherein the liquid ejecting apparatus farther comprises a platen that is arranged opposite the nozzle plate in a direction in which the liquid is discharged and supports the recording material, and said platen has a groove in which conductive metal foil acting as said electrode is arranged in a bottom face and accommodates said absorbing member in the groove.

4. The liquid ejecting apparatus as claimed in claim 3, wherein the metal foil is continuously formed in a substantially planar shape over an area on which said absorbing member is arranged on the bottom face.

5. The liquid ejecting apparatus as claimed in claim 1, wherein said electrode comprises:

an insular portion inserting hole for inserting said insular portion; and a notch for foot insertion for inserting said foot portion, which is integrally formed with said insular portion inserting hole.

6. A liquid ejecting apparatus comprising:

a liquid ejecting head that has a conductive nozzle plate and discharges liquid from openings of the nozzle plate to recording material;

an absorbing member that is arranged opposite the nozzle plate in a direction in which the liquid is discharged and has a voiding property absorbing liquid not attached to the recording material and electrical conductivity;

an electrode that is electrically connected to said absorbing member;

a potential difference generating means that generates a potential difference between the nozzle plate and said electrode to electrically attract the liquid toward said electrode;

a waste liquid absorber that has a voiding property lower than that of said absorbing member and holds the liquid absorbed into said absorbing member by being in contact with at least a part of said absorbing member; and a holding part that electrically insulates said waste liquid absorber from a periphery to hold said waste liquid absorber.

7. The liquid ejecting apparatus as claimed in claim 6, wherein the liquid ejecting apparatus further comprises:

a cap that covers the nozzle plate of said liquid ejecting head;

a tube that carries liquid discharged into said cap; and a cap side absorber that absorbs the liquid carried by said tube to hold the liquid, and said holding part electrically insulates said waste liquid absorber from said cap side absorber.

8. The liquid ejecting apparatus as claimed in claim 7, wherein the liquid ejecting apparatus further comprises:

a pump that carries the liquid in said tube; and a pump motor that drives said pump, and said holding part electrically insulates said waste liquid absorber from said pump motor.

9. The liquid ejecting apparatus as claimed in claim 6, wherein the liquid ejecting apparatus further comprises:

a guiding portion that supports said liquid ejecting head; and a conductive frame that supports said guiding portion, and said holding part electrically insulates said waste liquid absorber from said frame.

10. The liquid ejecting apparatus as claimed in claim 9, wherein the liquid ejecting apparatus further comprises a head motor that drives said liquid ejecting head along said guiding portion, and said holding part electrically insulates said waste liquid absorber from said head motor.

11. The liquid ejecting apparatus as claimed in claim 6, wherein the liquid ejecting apparatus further comprises:

a carrying portion that carries the recording material; and a carrying motor that drives said carrying portion, and said holding part electrically insulates said waste liquid absorber from said carrying motor.

12. The liquid ejecting apparatus as claimed in claim 6, wherein the liquid ejecting apparatus further comprises an electric circuit that controls said liquid ejecting head, and said holding part electrically insulates said waste liquid absorber from said electric circuit.

13. A liquid ejecting apparatus comprising:

a liquid ejecting head that has a conductive nozzle plate and discharges liquid from openings of the nozzle plate to recording material;

an absorbing member that is arranged opposite the nozzle plate in a direction in which the liquid is discharged and has a voiding property absorbing liquid not attached to the recording material and electrical conductivity;

an electrode that is electrically connected to said absorbing member;

a potential difference generating means that generates a potential difference between the nozzle plate and said electrode to electrically attract the liquid toward said electrode;

a waste liquid absorber that holds the liquid absorbed into said absorbing member by being in contact with at least a part of said absorbing member; and a holding part that holds said waste liquid absorber.

14. The liquid ejecting apparatus according to claim 13, wherein said waste liquid absorber has a voiding property lower than that of said absorbing member.

15. The liquid ejecting apparatus according to claim 13, wherein said holding part electrically insulates said waste liquid absorber from a periphery.

16. A liquid ejecting apparatus comprising:

a liquid ejecting head that has a conductive nozzle plate and discharges liquid from openings of the nozzle plate to recording material;

a first absorbing member that is arranged opposite the nozzle plate in a direction in which the liquid is discharged and has electrical conductivity to absorb liquid not attached to the recording material;

a second absorbing member which absorbs from said first absorbing member the liquid absorbed by said first absorbing member;

a platen arranged at a position facing the nozzle plate in the direction in which the liquid is discharged, said platen comprising an insular portion that penetrates and supports said first absorbing member, and said platen supporting the recording material;

an electrode that is electrically connected to a rear face of said absorbing member opposite a face facing the nozzle plate; and a potential difference generating means that generates a potential difference between the nozzle plate and said electrode to electrically attract the liquid toward said electrode, wherein said first absorbing member is in contact with said second absorbing member by a foot portion extending from said first absorbing member, and said insular portion is formed in the vicinity of said foot portion.

* * * * *